US006918757B2

(12) United States Patent
Nakamura et al.

(10) Patent No.: US 6,918,757 B2
(45) Date of Patent: Jul. 19, 2005

(54) COMBUSTION APPARATUS

(75) Inventors: Yutaka Nakamura, Akashi (JP); Hiroki Hasegawa, Kakogawa (JP); Hitoshi Hara, Kobe (JP)

(73) Assignee: Noritz Corporation (JP)

( * ) Notice: Subject to any disclaimer, the term of this patent is extended or adjusted under 35 U.S.C. 154(b) by 0 days.

(21) Appl. No.: 10/651,315

(22) Filed: Aug. 28, 2003

(65) Prior Publication Data

US 2004/0126725 A1 Jul. 1, 2004

(30) Foreign Application Priority Data

Aug. 29, 2002 (JP) ..... 2002-250546
Aug. 30, 2002 (JP) ..... 2002-255655

(51) Int. Cl.[7] ..... F23N 1/02

(52) U.S. Cl. ..... 431/89; 431/36; 431/37; 431/62; 431/171; 431/353

(58) Field of Search ..... 431/11, 12, 18, 431/36, 37, 62, 72, 73, 89, 90, 171, 353

(56) References Cited

U.S. PATENT DOCUMENTS

| | | | | |
|---|---|---|---|---|
| 3,592,574 A | * | 7/1971 | Zenkner | 431/160 |
| 4,621,771 A | * | 11/1986 | Chiba et al. | 239/585.4 |
| 6,581,573 B2 | * | 6/2003 | Nimura et al. | 123/496 |
| 2004/0043342 A1 | * | 3/2004 | Asano et al. | 431/1 |
| 2004/0126726 A1 | * | 7/2004 | Hamada et al. | 431/208 |

FOREIGN PATENT DOCUMENTS

| | | | | |
|---|---|---|---|---|
| JP | 58-140508 | | 8/1983 | |
| JP | 60-022069 | | 2/1985 | |
| JP | 62-186112 | | 8/1987 | |
| JP | 63-275870 | | 11/1988 | |
| JP | 01-167508 | | 7/1989 | |
| JP | 02-057816 | | 2/1990 | |
| JP | 02110210 A | * | 4/1990 | F23N/1/00 |
| JP | 03-063413 | | 3/1991 | |
| JP | 03-125814 | | 5/1991 | |
| JP | 03-221718 | | 9/1991 | |
| JP | 05-322153 | | 12/1993 | |
| JP | 08-049839 | | 2/1996 | |
| JP | 08-075141 | | 3/1996 | |
| JP | 09-049628 | | 2/1997 | |
| JP | 10-019156 | | 1/1998 | |
| JP | 10-205383 | | 8/1998 | |
| JP | 10-227453 | | 8/1998 | |
| JP | 11-241808 | | 9/1999 | |
| JP | 2000-018571 | | 1/2000 | |
| JP | 2000-161609 | | 6/2000 | |
| JP | 2000-249336 | | 9/2000 | |
| JP | 2000-304355 | | 11/2000 | |
| JP | 2001-065813 | | 3/2001 | |
| JP | 2001-140765 | | 5/2001 | |

* cited by examiner

*Primary Examiner*—Jiping Lu
(74) *Attorney, Agent, or Firm*—Wood, Phillips, Katz, Clark & Mortimer

(57) ABSTRACT

A combustion apparatus 2 has an anti-spreading member 65 disposed below a combustion chamber 10. This anti-spreading member 65 is composed of a generally cylindrical main body 65*a*, an outer flange 65*b* and an inner flange 65*c*, these flanges being formed at and integral with the opposite ends of the main body 65*a*, respectively. A controller 40 for regulating the operation of this apparatus 2 is designed to preheat the anti-spreading member 65 at a heat generation rate 'q' lower than the required heat generation rate 'Q', before the apparatus starts its normal operation to burn a fuel.

22 Claims, 12 Drawing Sheets

NOTES: "RATIO" DENOTES THE RATIO OF THE OPENED-VALVE'S PERIOD TO UNIT TIME.

COMBUSTION APPARATUS

BACKGROUND OF THE INVENTION

1. Field of the Invention

The present invention relates to a combustion apparatus for burning a liquid fuel.

2. Description of Related Art

Some combustion apparatuses known in the art are of the type as disclosed in Patent Laying-Open Gazette No. 10-227453. A fuel spraying nozzle incorporated in this apparatus operates to blow a fuel mist to be burnt continuously. This nozzle is of the so-called return type that has an internal return path such that a portion of the fuel supplied from a fuel tank will flow back toward the tank through the internal return path and a return channel provided out of the nozzle.

FIG. 11 is a scheme of the related art combustion apparatus 201 that incorporates the return type nozzle 205 for spraying the fuel and a combustion chamber 204 for burning the fuel sprayed by the nozzle 205.

The fuel spraying nozzle 205 built in this apparatus 201 has a spray mouth for jetting a fuel mist. A fuel channel (or "a fuel canal") 209 connected to the nozzle 205 is composed of a feed channel (or "a feed canal") 210 reaching the spray mouth and a return channel (or "a return canal") 211 leading back therefrom to an upstream region of said channel. The feed channel 210 starting from a fuel tank 214 so as to terminate at an inlet of the spraying nozzle 205 does include electromagnetic valves 212 and 213 and an electromagnetic pump 215 that are arranged in series along the feed channel. On the other hand, the return channel 211 connected to a returning side of the nozzle 205 does include a check valve 216 and a proportional control valve 217, that are likewise arranged in series. A downstream end of the return channel 211 merges into the feed channel 210, at a junction intervening between the electromagnetic valve 212 and the electromagnetic pump 215.

FIG. 12 shows the structure of proportional control valve 217 employed in the related art combustion apparatus 201. This valve has an internal fuel passage 221 formed in a casing 220 and extending between a fuel inlet end 222 and a fuel outlet end 223, with the inlet end 222 leading to the check valve 216. A valve seat 225 is formed at an intermediate point in the internal passage 221, and a spherical valve body 226 rests on this seat 225. A plunger 227 in contact with the valve body 226 is surrounded by an electromagnetic coil 228. With this coil being turned on with an electric current, it will make a stroke along the axis of casing so as to move the valve body 226 up and down.

As the plunger 227 displaces the valve body 226, the cross-sectional area of internal passage 221 will vary to change the flow rate of fuel advancing from the inlet end 222 to outlet end 223. A current regulator not shown but varying the intensity of electric power applied to the proportional control valve 217 will serve to control the fuel flow rate through the return channel.

The fuel stream effluent from the tank 214 will continuously be compressed in the electromagnetic pump 215, before entering the spraying nozzle 205.

The thus compressed fuel stream of a high pressure will reach the spray mouth that is located at a distal end of the spraying nozzle 205, so that a noticeable portion of such a fuel stream is blown outwards to form a mist to be burnt within the combustion chamber 204. The remainder of said fuel stream will flow back from this nozzle 205, through the check valve 216 and into the inlet end 222 of the proportional control valve 217. The remainder having entered this valve 217 through its inlet end 222 is delivered to an upstream region of the feed channel, at a flow rate determined by the intensity of current being applied to said coil 228.

In the related art combustion apparatus 201, a major portion of the fuel sprayed out of the nozzle 205 is burnt within the combustion chamber 204. The remainder of fuel, that is a minor portion thereof, not burnt will however advance into a downstream region of this chamber 204, and this region is at a temperature lower than that in an upstream region of said chamber. The combustion chamber 204 will remain cold in a period just after commencement of combustion process. In the event that such a minor portion of fuel would enter the cold downstream region, it will stick to the inner peripheral surface of said chamber. The minor portion is thus prone to be cooled to cause aggregation of mist particles of fuel, being discharged as an unburnt waste of fuel.

In the apparatus 201, the amount of heat generated per unit time is controlled by adjusting the spraying rate, which in turn is adjusted by regulating the flow rate of fuel to be burnt. Therefore, such a minor portion sprayed from nozzle 205 but not burnt will cause a loss of fuel. An actual amount of heat will be short of the required amount of heat to be generated, resulting in a poor efficiency in generation of heat.

Gradual change or certain fluctuation in the temperature of the proportional control valve 217 has been observed in the related art combustion apparatus 201 during its operation. Such a change or fluctuation as being caused by the change in ambient temperature and/or the like will in turn change the temperature of coil 228 installed in the casing 220. Electric resistance of the coil 228 will vary in response to the change in its temperature, thereby rendering unstable the current intensity applied to the coil 228. Consequently, the flow rate at which the remainder of fuel stream flows back through the return channel will become unreliable. It has been somewhat difficult for the related art apparatus 201 to precisely regulate the spraying rate of fuel, failing to stabilize the condition of combustion state.

SUMMARY OF THE INVENTION

An object of the present invention made in view of the problems and drawbacks mentioned above is therefore to provide an advanced combustion apparatus that is simplified in structure, but is nevertheless possible to accurately regulate the sprayed rate of a fuel to ensure complete combustion.

In order to achieve this object, a combustion apparatus provided herein has to comprise a spraying means for spraying a fuel to form a fuel mist stream, a combustion chamber designed to burn therein the fuel mist stream to form a flame, and a fuel channel through which the fuel flows. The apparatus has to further comprise an anti-spreading means disposed at a downstream region of the combustion chamber so as to inhibit the fuel mist stream and the flame from freely spreading radially and outwardly out of the downstream region.

The anti-spreading means will not only prevent such a spread of the fuel mist stream but also retain same temporarily in this means. A hot gas as the combustion product will also temporarily stay within the anti-spreading means. There may exist in the fuel mist stream any portion thereof that would not have completely burnt at the time when it reaches the anti-spreading means. However such an incompletely burnt fuel mist will be heated with the hot body of said means and also with the hot gas stagnant therein, thereby facilitating complete combustion.

Thus, the fuel sprayed in this apparatus will now be completely burnt almost in its entirety, minimizing production of toxic gases such as carbon monoxide and/or soot. Environmental pollution is avoided on one hand, and the apparatus is protected from damage that would otherwise result from accumulation of soot.

In order to also achieve the object mentioned above, a combustion apparatus provided herein may comprise a spraying means for spraying a fuel to form a fuel mist stream, a combustion chamber designed to burn therein the fuel mist stream to form a flame, and a fuel channel through which the fuel flows. The apparatus further comprises an anti-spreading means disposed at a down-stream region of the combustion chamber so as to inhibit the fuel mist stream and the flame from freely spreading radially and outwardly out of the downstream region. The anti-spreading means is capable of being preheated prior to combustion carried out in the combustion apparatus.

Also in this case, any incompletely burnt fuel mist will be heated with the hot body of said means and also with the hot gas stagnant therein, thereby facilitating complete combustion.

If the combustion process is started just after switching on the apparatus, then anti-spreading means is likely to be undesirably cold. The fuel sprayed into the combustion chamber and/or the flame of said fuel being burnt will contact such a cold anti-spreading means, possibly causing aggregation of mist particles. The preheating of this means will be effective to avoid such problems of fuel aggregation and the like.

Because the anti-spreading means for preventing the radial spread of mist stream will be preheated prior to any or every combustion process, any number of fuel mist particles having aggregated or going to aggregate together in the combustion chamber will be assisted to vaporize so as to be burnt completely.

The anti-spreading means is located in the downstream region of said combustion chamber, but the flame of fuel or the fuel particles may nevertheless reach this means. The required heat and the required flow rate of fuel to be burnt will be an important parameter deciding whether such an occasion does or does not take place. Accordingly, the anti-spreading means may be preheated if the required amount of heat generated per unit time (otherwise called "required heat generation rate") is equal to or exceeds a predetermined limit.

The anti-spreading means may be preheated by increasing in a stepwise manner a feeding rate of the fuel being fed to the spraying means.

In this case, sudden change will be avoided during the combustion process, thereby enabling a smooth operation of the apparatus.

If any excessive amount of ambient air is introduced into the combustion chamber during the preheating, then the anti-spreading means may undesirably be cooled to impair the effect of this step. Therefore, the combustion apparatus of the invention may preferably be capable of reducing flow rate of air into the combustion chamber while the anti-spreading means is preheated.

The heat generated by the preheating will in this case be transmitted to the anti-spreading means, without being cooled down with such an excessive amount of ambient air. Thus, the combustion process can transfer into its normal phase smoothly and within a shorter time.

Preferably, the anti-spreading means for preventing the radial spread of mist stream may have a wall extending in a direction of the mist stream and smoothly continuing from the combustion chamber.

Such a peripheral wall will inhibit the fuel mist from spreading in a direction perpendicular to the spray direction, thereby temporarily holding this stream in the anti-spreading means. The hot combustion gas will also be caused to stay for a time within this means.

The hot and stagnant combustion gas will mix with the fuel fraction having not burnt, thereby to assist the latter to vaporize smoothly. Almost all the amount of sprayed fuel is thus subjected to combustion process, enhancing its efficiency.

The apparatus has to surely and temporarily cause the incompletely burnt fuel portion and the hot combustion gas to stay therein. Thus, the anti-spreading means may have near its downstream end a gas-staying member (or portion) that will serve as a constricted outlet opening.

This structure will afford a highly efficient combustion of the sprayed fuel.

The anti-spreading means may have a plurality of ventilative holes formed through the anti-spreading means such that the interior and the exterior of the means communicates with each other through the ventilative holes. The ventilative holes may be formed through at least one of the said wall and the gas-staying member of the anti-spreading means.

Some portions of a combustion gas and the flame generating from the fuel will be allowed to escape sideways to the outside of the anti-spreading means, through the ventilative holes. Thus, stream of the combustion gas dashing towards the downstream end of said means will be stabilized by means of inhibition of the flame from prolonging itself excessively in the direction of spraying the fuel.

Thanks to some limited or minor flame portions transversely flowing outwards through the ventilative holes, the flame blown from the combustion chamber will not simply prolong itself but moderately and orderly expand across the peripheral wall of the anti-spreading means, in a direction perpendicular to the spraying direction. Such an optimally extended distal face of the flame will uniformly heat a target article, even if the article would be located adjacent to this apparatus.

It is a beneficial effect of the present apparatus that a heating apparatus such as a hot water supplier having this apparatus built in it can be made smaller in size.

For the sake of complete combustion of fuel, a sufficient amount of fresh air fed to the combustion chamber should be at a certain positive pressure. In contrast, exposed to ambient pressure is the anti-spreading means performing the function noted above. Therefore, an adequate balance in air/gas pressure has to be kept between the anti-spreading means and the combustion chamber, particularly the interior thereof.

In view of such a requirement, the apparatus may involve a casing to enclose the combustion chamber so as to form a semi-closed space around the chamber. The anti-spreading means will be connected to an outer end face of this casing.

This structure will enable it to feed a necessary amount of air into the combustion chamber. The unburnt fuel fraction as well as the combustion gas will be assisted to more surely stay for a while within said anti-spreading means.

The combustion apparatus comprising the described anti-spreading means may show a certain problem if the combustion rate is so low as disabling the fire flame to directly contact said means. In such a case, the anti-spreading means will be heated relatively slowly by means of radiation and transmission of heat from the combustion chamber and contact with hot combustion gas. If any amount of fuel particles would stick to the peripheral wall of said anti-spreading means before it had not been heated to a sufficiently high temperature, then they might aggregate together.

The present inventors have conducted a series of researches to find that if any air stream produced by an air blowing means such as a blower, a fan and a compressor would impinge on the anti-spreading means, then the latter might be cooled. Thus, the present invention provides a combustion apparatus rendered free from such an inconvenience. It may comprise an air-blowing means that is attached to the casing's portion remote from the anti-spreading means secured to the outer end face of the casing.

The anti-spreading means will no longer be subjected to any forced cooling with an external fresh air, but being smoothly heated. A balance of pressure between the exterior and interior of said anti-spreading means will stand stable, not being affected by the forced air flow. The unburnt portion of sprayed fuel flowing out of a downstream zone of the combustion chamber is now permitted to stay surely for a time in the anti-spreading means that is located downstreamly of the downstream zone, so as to be burnt completely.

Preferably, the apparatus may involve a casing to enclose the combustion chamber so as to form a semi-closed space around the combustion chamber, and the casing may have an air-distribution adjuster. This adjuster will function to adjust the ratio of an air flow rate into an upstream region of the interior of the combustion chamber to another air flow rate into a downstream region of the interior of the combustion chamber.

Thanks to the air-distribution adjuster, the ambient air can enter only one of or both the upstream and downstream regions of said interior, respectively at desired flow rates to stabilize combustion.

In response to the level of the required amount of heat, the flow rate of fuel being strayed into the combustion chamber, as well as the size of fire flame, will vary time to time. In detail, the stream of fuel mist and the flame will extend to the downstream region at higher combustion rates, whereas they will stay in the upstream region at lower required amount of heat.

Also preferably, the apparatus may involve a casing to enclose the combustion chamber so as to form a semi-closed space around the chamber, and the casing may have an air-distribution adjuster. The adjuster will function to adjust the ratio of a rate of an air flow rate into an upstream region of the interior of the chamber to another air flow rate into a downstream region of the interior of the chamber. In particular, the air-distribution adjuster may be designed to reduce the said ratio at lower required heat generation rates to that at higher required heat generation rates.

In this case, flow rates of ambient air supplied to the respective regions of combustion chamber can be optimized, regardless of any change in the conditions of combustion process.

The combustion chamber in the present apparatus may be provided with an air revolving means so that air introduced into the chamber are forced to swirl therein.

Such swirling air streams will facilitate homogeneous mixing of the fresh air with the fuel being sprayed, thus affording smooth and complete combustion.

The combustion chamber may have a diameter increasing towards the downstream region.

The fuel mist stream jetting from the spraying means will naturally form a pattern that gradually increases its diameter towards the downstream region of combustion chamber. Thus, the configuration of said generally cylindrical chamber does match the shape of mist stream forming a fire flame, whereby distance in radial direction between the inner periphery of the chamber and the outer periphery of such a mist stream or flame will scarcely vary longitudinally of said chamber. Transfer of heat will take place uniformly all over the full length of combustion chamber, affording uniform distribution of internal temperature thereof. The fuel sprayed into this chamber will almost completely be burnt without suffering from aggregation of mist particles.

More preferably, the combustion chamber has a diameter increasing towards the downstream region, and further has a plurality of aspiratory holes such that the interior and the exterior of the chamber are kept in fluid communication with each other through the aspiratory holes.

Thanks to the peripheral wall having such aspiratory holes and its configuration matching the shape of running mist stream and flame, the fuel will smoothly receive a sufficient amount of air through those holes even if it would be sprayed at a location adjacent to said wall, thus being burnt in a stable manner.

The interior of combustion chamber may be divided into a plurality of successive flaming sections of different diameters, with an annular shoulder intervening between each section and the next one. In this case, any non-negligible amount of soot or the like combustion byproducts may accumulate on such a step-like shoulder, undesirably hindering complete combustion or injuring the apparatus.

Therefore, in employing a combustion chamber divided into a plurality of flaming sections of different diameters, a further air revolving means may be provided on at least one of the shoulders each formed between adjacent two of the sections so that air introduced into the chamber will be forced to swirl therein.

Such air revolving means will facilitate the mixing of air with fuel, contributing to complete combustion.

Further, even if any amount of soot or the like would be produced tending to stick to the face of such a shoulder, it will surely be blown off by the whirling air stream formed by the air revolving means, thus avoiding the problems just mentioned above.

The present inventors have carried out further performance tests on the apparatus as summarized above, to find that although it generally operated smoothly initiating combustion process and avoiding production of byproducts such as soot, another problem would occasionally occur. This unusual problem was caused by a noticeable amount of ambient air entrained into the fuel flowing through the fuel channel, resulting in an insufficient feeding of fuel to the spraying means and a failure in igniting the fuel.

As the countermeasure for avoiding such a possible problem, the anti-spreading means may be preheated by increasing in a stepwise manner a feeding rate of fuel being fed to the spraying means. In the event that a failure in ignition would happen when starting the preheating, the feeding rate will be raised to a higher average rate.

The problem of entraining the ambient air will be resolved in this manner of forcing a sufficient amount of fuel towards the spraying means. In a case wherein the return type nozzle is employed as this means, the return path will be throttled to increase the spraying rate through this nozzle, in order to compensate such a poor and unstable feed of fuel thereto caused by the entrained ambient air. Failure of ignition will be avoided immediately in this way, upon the sensing of any tendency for the ignition to fail.

The combustion apparatus may further comprise an intermittently operating valve disposed in the fuel channel. This valve may be capable of being opened and closed periodically under the duty-ratio control conducted in response to the required amount of heat per unit time.

This intermittently operating valve will regulate the flow rate by modifying a frequency of valve body's motions to open and close the valve, unlike the conventional proportional control valves. Consequently, no fluctuation will be observed in flow rate and spraying rate of the fuel, irrespective of any change in ambient temperature.

Accurate control of the spraying rate of fuel will thus be ensured to completely, effectively and efficiently burn a necessitated amount of fuel, generating any required amount of heat per unit time.

As a result of still further performance tests on the apparatus just summarized above, the present inventors has found that its fuel channel may comprise a feed channel leading to the spraying means and a return channel for returning a portion of the fuel once forwarded to the spraying means, with the intermittently or periodically operating valve being disposed in the return channel.

Such a structure will be useful to minimize the pressure pulsation of fuel being fed to the spraying means, thus stabilizing the combustion process and diminishing the noise that will be generated during this process.

Instead of using the anti-spreading means to be preheated, the present apparatus may incorporate a member such as a baffle plate or the like also placed in the downstream region of combustion chamber. This plate or the like will serve as a target which the sprayed fuel and/or the flame do contact and heat. Also in this case, aggregation of fuel particles as well as the cooling of the flame will be avoided to ensure stable and sure combustion of the fuel.

BRIEF DESCRIPTION OF THE DRAWINGS

FIG. 4(*b*) is a graph of the zero-crossing signals generated in response to the cycles shown in FIG. 4(*a*);

FIG. 4(*c*) is a graph of the cycles of a modified current obtained by rectification of to the cycles shown in FIG. 4(*a*);

FIG. 4(*d*) is a graph showing the sequential variations observed in the discharge pressure of the pump to which the rectified current of FIG. 4(*c*) is being applied;

FIG. 4(*e*) is a graph of the successive pulses applied to an injector valve as the intermittently operating valve;

DESCRIPTION OF THE PREFERRED EMBODIMENTS

Figure 1:
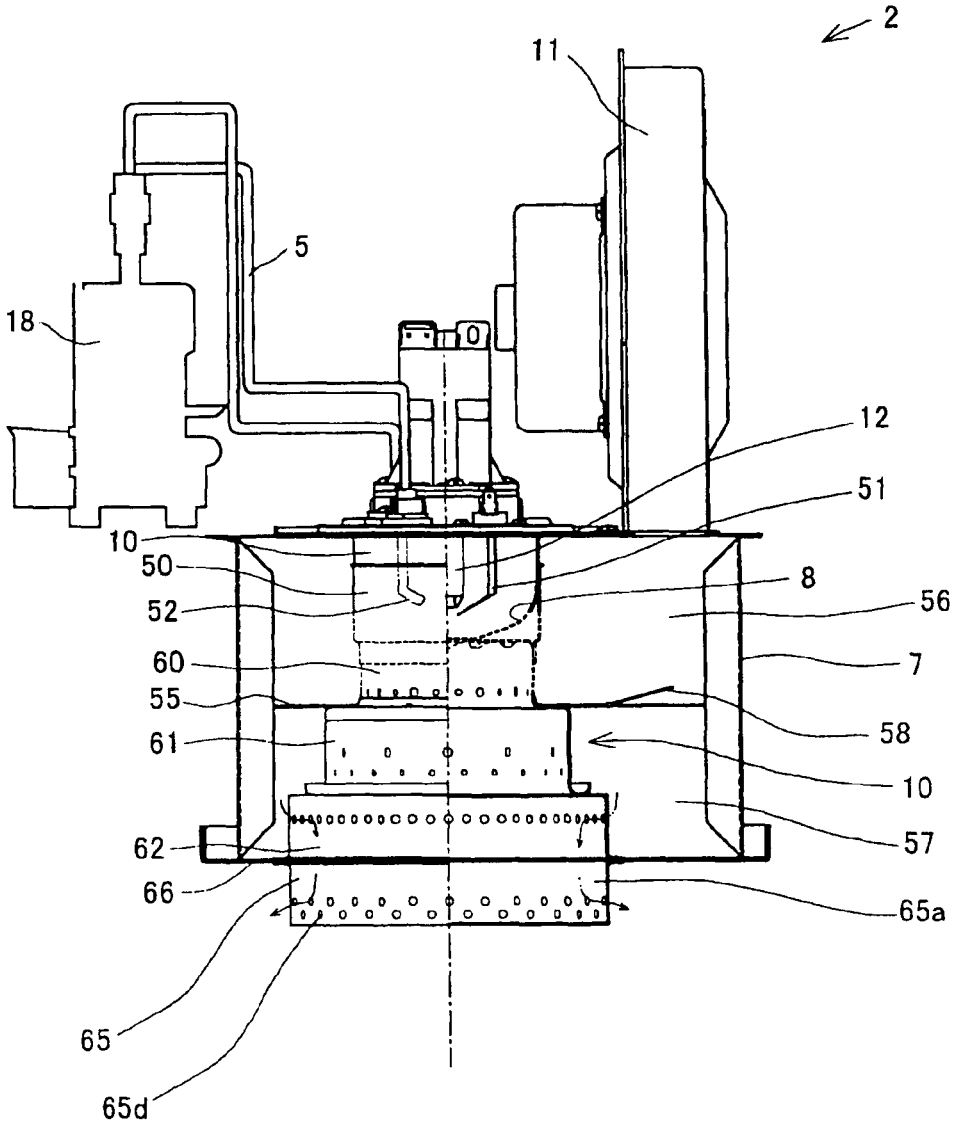
FIG. 1 is a front elevation of a combustion apparatus provided in an embodiment of the present invention and shown partly in cross section.

In FIG. 1, a combustion apparatus of a first embodiment is generally denoted at the reference numeral 2. This apparatus 2 comprises a nozzle block 8 having an end opened in a casing 7, and a combustion chamber 10 is attached to the end of nozzle block 8. A fan or blower 11 mounted on the casing 7 will operate to feed the ambient air into the combustion chamber 10. A fuel spraying nozzle (as the spraying means) 12 is installed in the nozzle block 8 in order to spray a fuel towards and into the combustion chamber 10.

The spraying nozzle 12 has a spray mouth (not shown) for jetting the fuel. An internal feed path (not shown) and an internal return path (not shown) leading to or starting back from the spray mouth are formed in or for the nozzle 12. Thus, the fuel spraying nozzle 12 will operate to jet a portion of the fuel that is being fed from the outside through the feed canal. The remainder of said fuel will be left unsprayed to subsequently flow back through the return canal.

Figure 2:
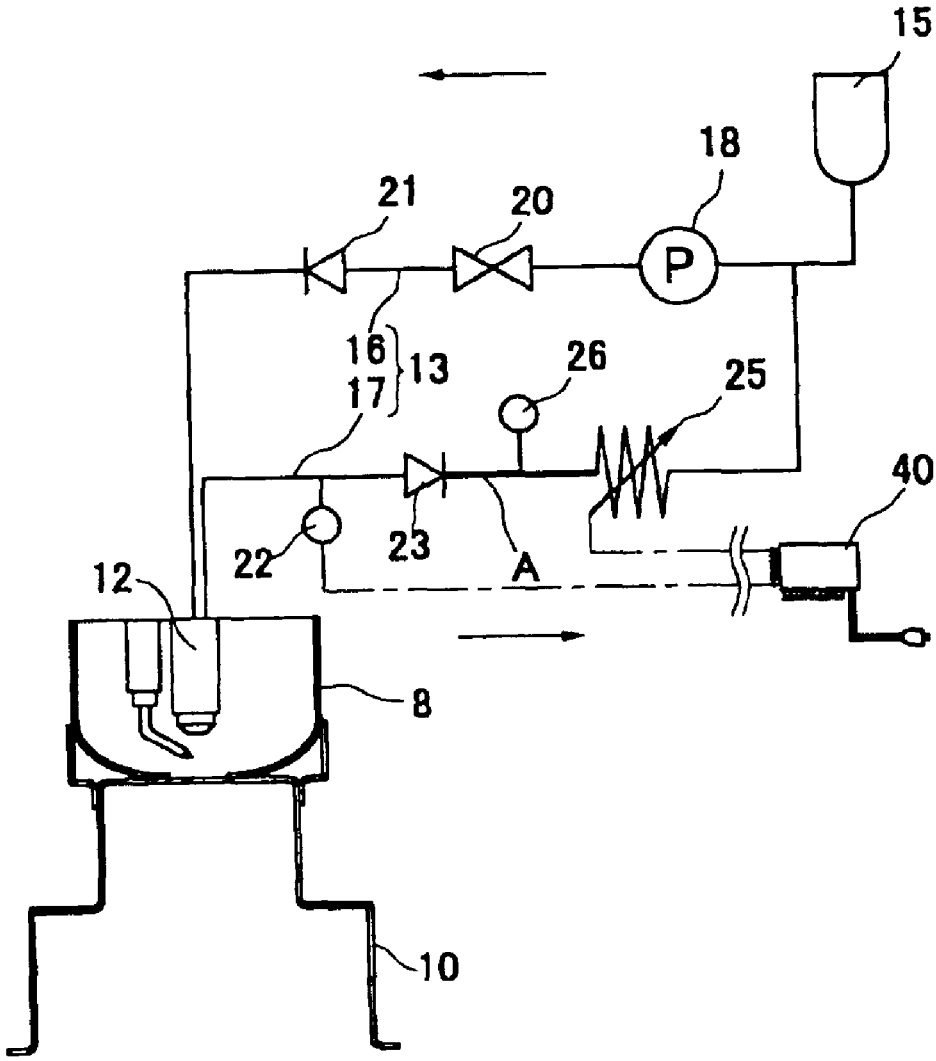
FIG. 2 is a diagram showing a fuel pipe line that is constructed in the apparatus shown in FIG. 1.

As seen in FIG. 2, a fuel pipe line 13 connects the fuel spraying nozzle 12 to a fuel tank 15 holding therein a mass of the fuel. The pipe line 13 consists mainly of a fuel feed canal (i.e., a feed channel) 16 and a return canal (i.e., a return channel) 17, such that the former canal communicates with an internal feed path formed in the nozzle 12 and the latter canal 17 communicates with an internal return path also formed in the spraying nozzle 12. As shown in FIG. 1, pipes 5 forming those feed and return canals 16 and 17 extend outwardly of the casing 7 so as to lead to an injector valve 25 and an electromagnetic pump 18, that are detailed below. Those pipes 5 also connected to the nozzle 12 are each bent several times at substantially right angles between the nozzle and the valve 25 or pump 18. Bends formed thus in said pipes will make same more tenacious on one hand, and will attenuate any vibration being transmitted from said pump 18 or injector valve 25 on the other hand. Thus, such a vibration will scarcely reach the spraying nozzle 12, thereby protecting it from damage.

The feed canal 16 combining the nozzle 12 with the fuel tank 15 in series does serve to supply the nozzle with the fuel stored in the tank. Disposed in this canal 16 are the electromagnetic pump 18, an electromagnetic valve 20 and a check valve 21. The check valve 21 normally stands closed, and an activation pressure (that is a minimum actuating pressure) for opening this valve is higher than a maximum hydrostatic head of the fuel in tank 15 standing in fluid communication with the feed canal 16. In other words, the hydrostatic pressure caused by the fuel stored in the tank 15 will never exceed the minimum pressure for activating the checking valve 21 to open. For example, in the combustion apparatus 2 of the present embodiment, the fuel tank 15 is disposed higher than the valve 21 by 0.5 meter. The minimum actuating pressure is 0.2 $Kgf/cm^2$ (viz., $2.0\times10^4$ Pa) for this valve 21, that is much higher than the hydrostatic head 0.04 $Kgf/cm^2$ (viz., $0.39\times10^4$ Pa) for the fuel in tank 15. Thus, the fuel will not flow towards the spraying nozzle 12 unless the pump 18 compresses it. Although the minimum actuating pressure for said valve 21 is selected herein to be high by about 5 times of said hydrostatic head of said fuel, the ratio of the former to the latter may fall within a range from 3 to 5.

The fuel tank 15 may alternatively be positioned at any height, from 1.5 m above to 2.0 m below the valve 21, thus making the hydrostatic head not higher than 0.12 $Kgf/cm^2$ (viz., $1.2\times10^4$ Pa).

As noted above, the normally closed check valve 21 shall not naturally open merely due to hydrostatic head of the fuel in tank 15. There may be a possibility that the electromagnetic valve 20 would unintentionally open, though fuel feed to the nozzle 12 had to be interrupted for the combustion apparatus 2 then standing inoperative. Even in such an accident, the check valve 21 will surely stop the fuel not to leak out towards a downstream canal region. If and when the fuel from the tank 15 has to be sprayed, it will be compressed by the pump 18 and enabled to pass through the valve 21 and flow to the nozzle 12.

A portion of the fuel fed to the nozzle 12 will be left there unburnt, and such a remainder will flow back towards the tank 15 through the return canal 17. A downstream end (near the tank 15) of the return canal 17 merges into the feed canal 16 at its intermediate point located on the upstream side of electromagnetic pump 18 (and facing the tank 15). Disposed at another intermediate point of the return canal 17 is a temperature sensor 22 for detecting the temperature of fuel flowing back through this canal. A further check valve 23 is disposed downstreamly of the sensor 22 so that the fuel can flow towards the tank 15 but is inhibited from flowing in a reversed direction away from this tank. Disposed on the downstream side of the check valve 23 is the injector valve (viz., intermittently operating valve) 25 that will be opened and closed periodically at given time intervals. An accumulator 26 intervening between the injector valve 25 and the further check valve 23 will serve to buffer fluctuation in pressure of the fuel flowing through the return canal 17.

Figure 3:
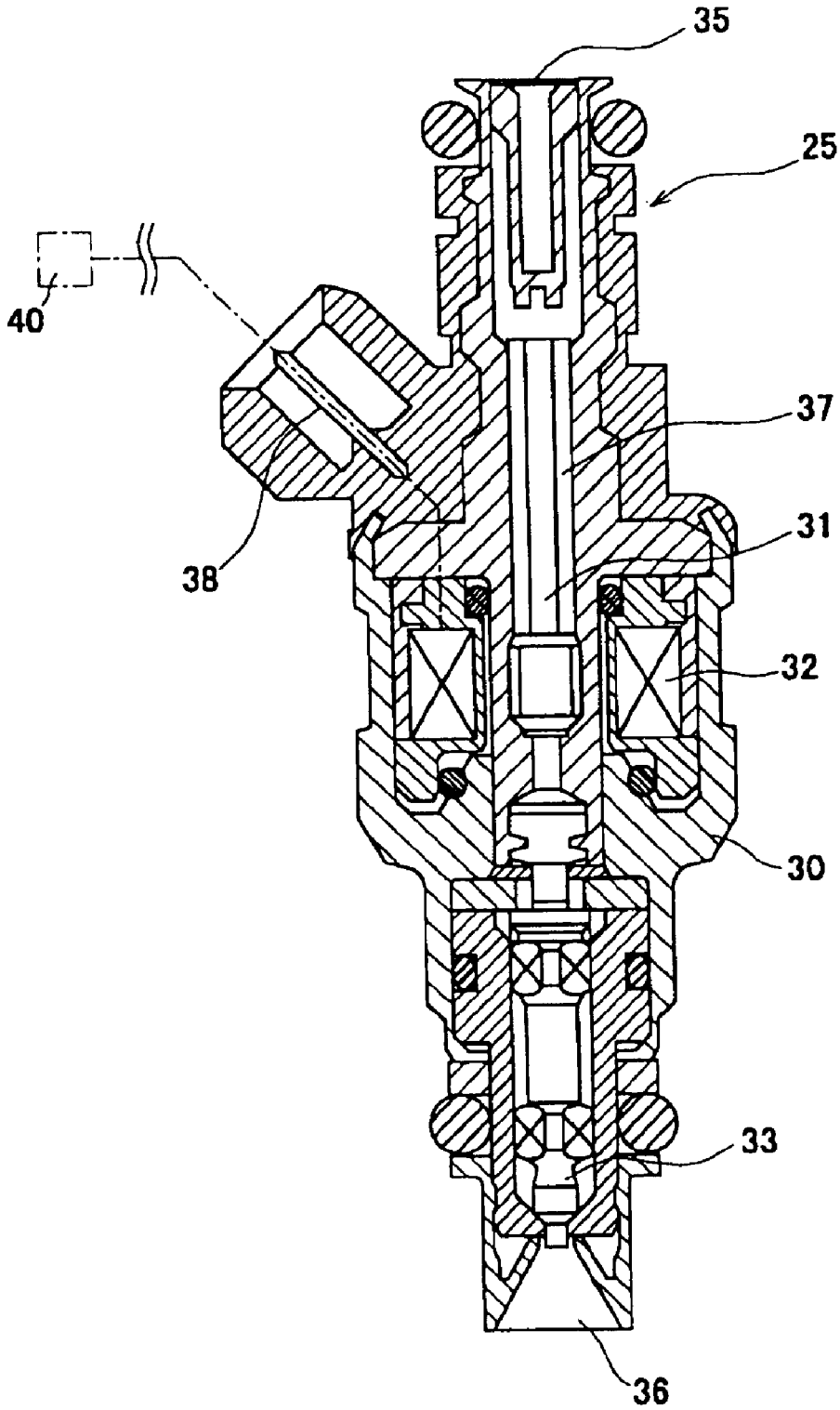
FIG. 3 is a cross section of an intermittently operating valve incorporated in the apparatus of FIG. 1.

The injector valve 25 will operate at an extreme high frequency to be opened and then instantly closed. As shown in FIG. 3, this valve 25 comprises a shell 30, an actuator 31 held therein, an electromagnetic coil 32 for driving the actuator 31, and a valve body 33 movable in unison with the actuator 31. Formed at opposite ends of the shell 30 are a fuel inlet 35 and a fuel outlet 36, with an internal fuel passage 37 extending between them 35 and 36 and through the shell 30.

The shell 30 has a terminal 38 leading to the electromagnetic coil 32 so that power supply through this terminal 38 will activate said coil 32. Consequently, the actuator 31 will be energized within the shell 30, thereby simultaneously driving the valve body 33 to open the passage 37 that is a part of the return canal 17. The valve body 33 of the present embodiment thus opens the passage 37 instantly in response to the coil 32 energized with an electric current, and said body 33 will close the passage instantly upon inactivation of said coil 32. The injector valve 25 in such a closed state in response to inactivated coil 32 will have its valve body 33 very tightly shutting the fuel passage 37 to absolutely close the return canal 17.

The terminal 38 is connected to a controller 40 that is incorporated to regulate the spraying rate of fuel jetting from the nozzle 12 and also to regulate the operation of fan or blower 11. The controller 40 is designed to periodically or intermittently activate the coil 32 to displace the valve body 33 to open and to close the passage, thus controlling the flow rate of fuel being sprayed from the nozzle 12.

The controller 40 feed to the electromagnetic coil 32 a pulse current synchronous with the power source for the electromagnetic pump 18. This pulse current will be detailed below.

Figure 4:
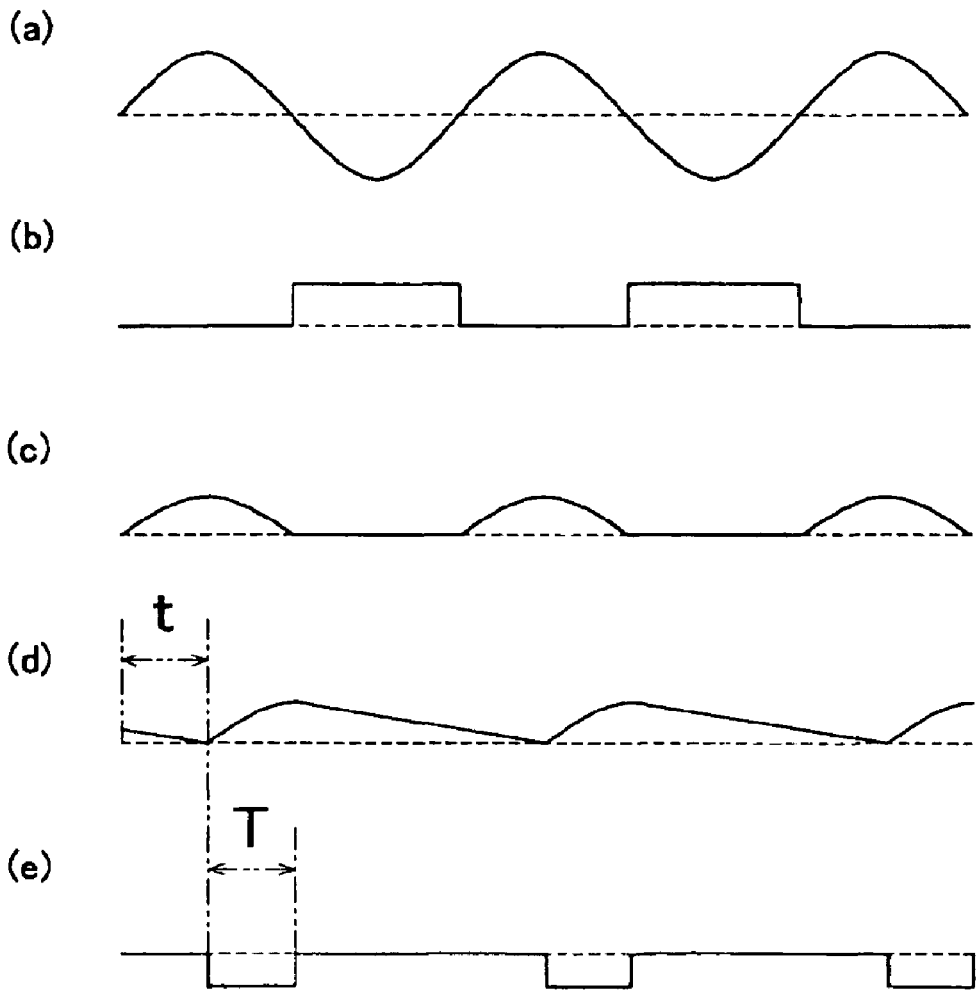
FIG. 4(*a*) is a graph of the alternating cycles of a power source for driving a pump incorporated in the apparatus of the embodiment.

The pump 18 receives an alternating current that changes its phase periodically as shown in FIG. 4(*a*), after this current is rectified as shown in FIG. 4(*c*). The pressure at which the pump 18 discharges the fuel will thus periodically change, following the alternating current fed to said pump 18 from the power source, as shown in FIG. 4(*d*). Each change in the pump's discharge pressure is delayed by a time 't' from the corresponding phase shift in the alternating current. The controller 40 detects every point at which the intensity of current becomes null (zero) in the alternating current power source. In detail, upon the time lapse 't' from the trailing edge of each pulse of zero-crossing signal, every command signal pulse will be generated for a time 'T' predetermined based on the required amount of fuel to be burnt per unit time, as shown in FIG. 4(*e*).

The fuel spraying nozzle 12 incorporated herein will cooperate with the injector valve 25 that remains open so long as the terminal 38 is receiving the current. The valve body 33 will however close the valve 25 upon interruption of the current to the terminal 38. Thus, this valve body 33 will open the valve 25 instantly and at the same time as the command signal pulse becomes 'ON'. The valve body 33 will however closed the valve 25 also instantly and at the same time as the command signal pulse becomes 'OFF'.

In the control mode just summarized above, the required amount of heat 'Q' that will be generated per unit time by burning the fuel at a flow rate will be met herein by appropriate methods such as the so-called 'PWM' control (viz., pulse width modulation control) and the duty-ratio control. The duty-ratio control for the injector valve 25 is such that the ratio (viz., duty ratio) of a period of 'ON' (viz., the opening) to another period of 'OFF' (viz., the closing) of said valve body is changed to regulate the opened valve's period. For lower levels of the required heat generation 'Q', the duration of 'ON' status will be rendered longer than the duration of 'OFF' status during each pulse, thereby holding the valve 25 open for a longer time. Contrarily for higher levels of said required heat generation 'Q', the duration of 'OFF' status will be made longer than the duration of 'ON' status during each pulse, thereby holding the valve 25 closed for a longer time. The intermittently operating valve 25 in the return canal will operate in this way to change the timing at which its valve body does interrupt or permit the fuel flow, so that an effective flow rate of the fuel through the feed canal may be adjusted.

It is noted here that the electromagnetic pump 18 always imparts a constant discharge pressure to a fuel flow that is being urged by this pump towards the nozzle 12 in this apparatus 2. Any change in the flow rate of the fuel being discharged from said pump will never affect the constant discharge pressure. Thus, the valve body 33 of injector valve 25 is always subjected to a constant pressure.

The valve body 33 will open the passage in response to a pulse current input to the terminal 38. A portion of fuel is thus blown back from the outlet of injector valve 25 at a constant return pressure, that is ensured by virtue of the constant discharge pressure of said pump. The amount of fuel having returned back through the injector valve 25 in a given period of time does depend on an overall time in which the valve body 33 has been open during this period. Thus a constant amount of fuel per unit time flows through the valve at a constant pressure when the pulse current applied to the terminal 38 is "ON". Thus, the amount of fuel that will have passed the injector valve 25 can be regulated by means of the time period in which the valve body 33 will be kept open during this time period. More specifically, the flow rate of fuel flowing back into and passing through the return canal 17 will be regulated by adjusting 'ON' time period of the pulse current applied to the valve 25 by means of the controller 40 by the method of so-called 'PWM' control or 'duty-ratio' control, so as to realize a desired flow rate of said fuel to be burnt at the spraying nozzle 12.

So long as the apparatus is inoperative not to conduct combustion process, the controller 40 will interrupt the current to the coil 32, thus tightly closing the injector valve 25. The return canal 17 is thus closed at the two checkpoints, that is, the check valve 23 and injector valve 25.

Figure 5:
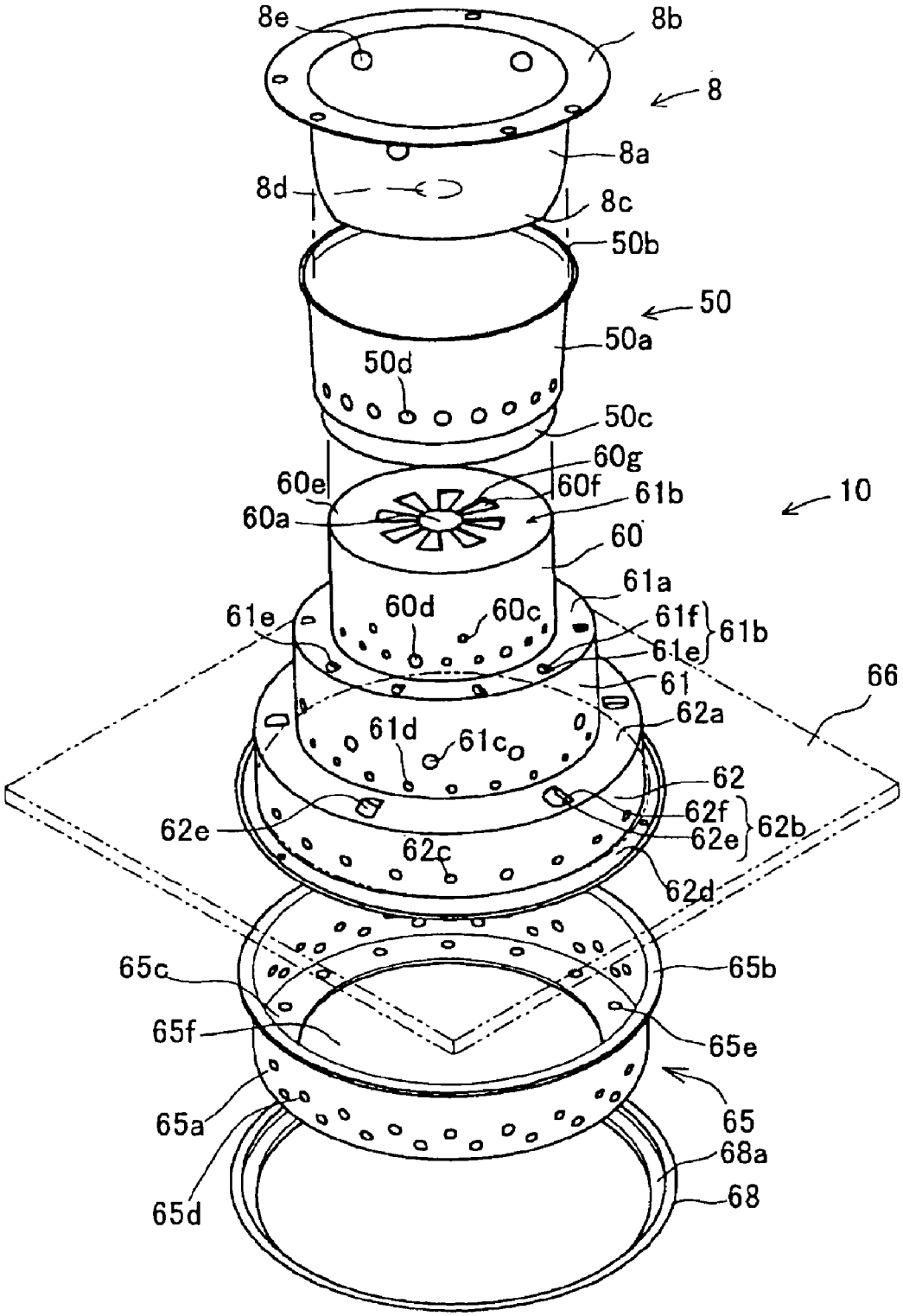
FIG. 5 is an exploded perspective view of a combustion chamber shown in FIG. 2 and an anti-spreading member (as an anti-spreading means)

As mentioned above and shown in FIG. 1, the spraying nozzle 12 is installed in the nozzle block 8. This block is connected by a primary air-intake cylinder 50 to the combustion chamber 10, as shown in FIGS. 1 and 5. The nozzle 12 for spraying the liquid fuel into this chamber 10, an ignition plug 51, and a flame sensor 52 for detection of fire flame, are accommodated in the nozzle block 8.

Figure 6:
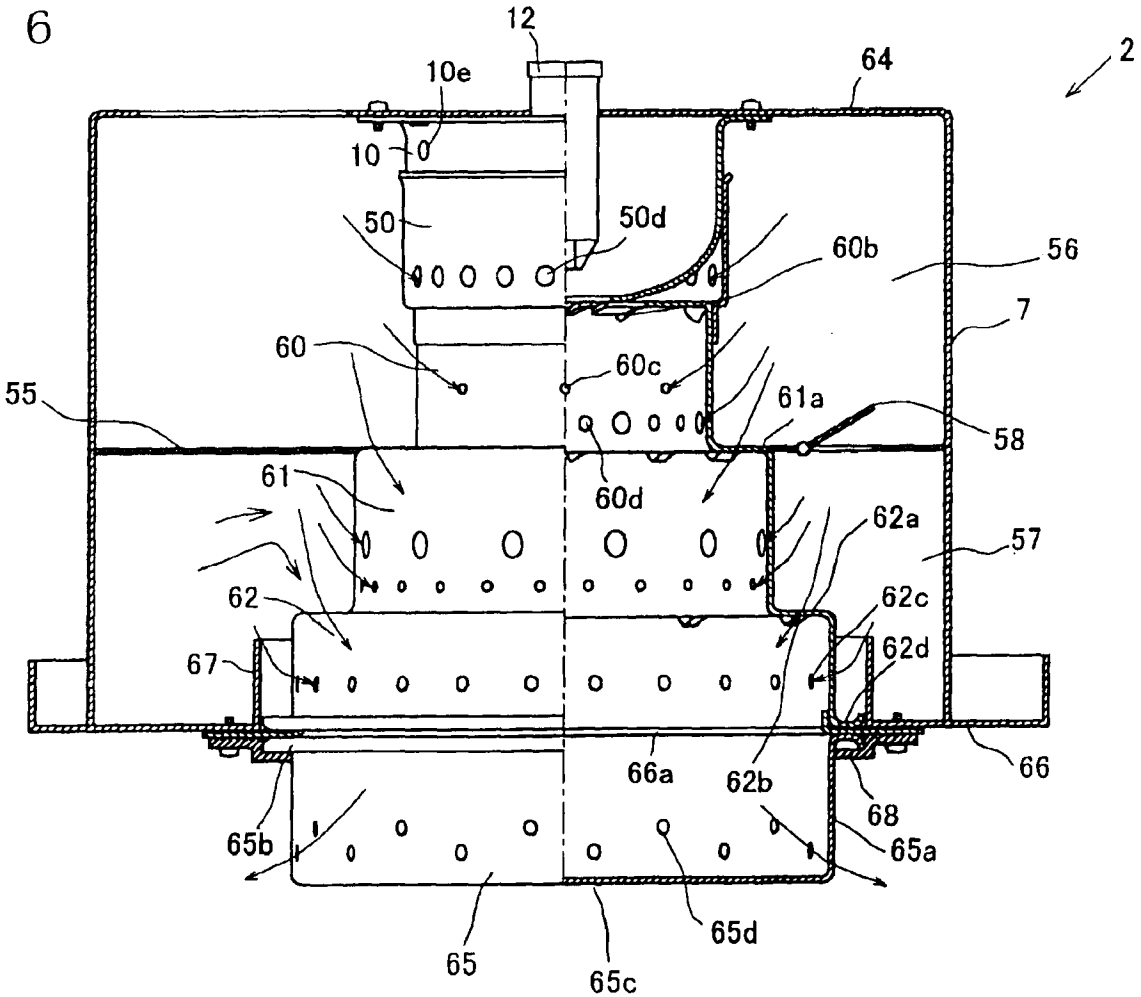
FIG. 6 is a cross section of the primary part of the apparatus shown in FIG. 1.

As seen in FIGS. 1 and 6, an air casing 7 defines therein an internal space divided by a partition 55 into an upper first space 56 (corresponding to an upstream region of the interior of the combustion chamber) and a lower second space 57 (corresponding to a downstream region of the interior of the combustion chamber). A damper 58 formed in the partition 55 is capable of operation to change the flow rate of the air introduced into the second space 57. The number of rotations per unit time of the blower 11, as well as the degree to which the damper is to be opened, will be regulated to supply the upstream and down-stream regions of the interior of combustion chamber 10 with a proper amount of air needed to effect the required amount of heat per unit time. In detail, if such a required amount of heat is relatively high, then a relatively large amount of air will be necessary, and the flame being produced by combustion of the fuel will extend to the downstream region of the sprayed fuel mist. Therefore, the number of rotations per unit time of the blower 11 will be increased, and the damper 58 will be opened largely. If contrarily such a required amount of heat is relatively low, then number of rotations of blower 11 will be reduced, and the damper 58 will be opened to a lesser extent.

Figure 7:
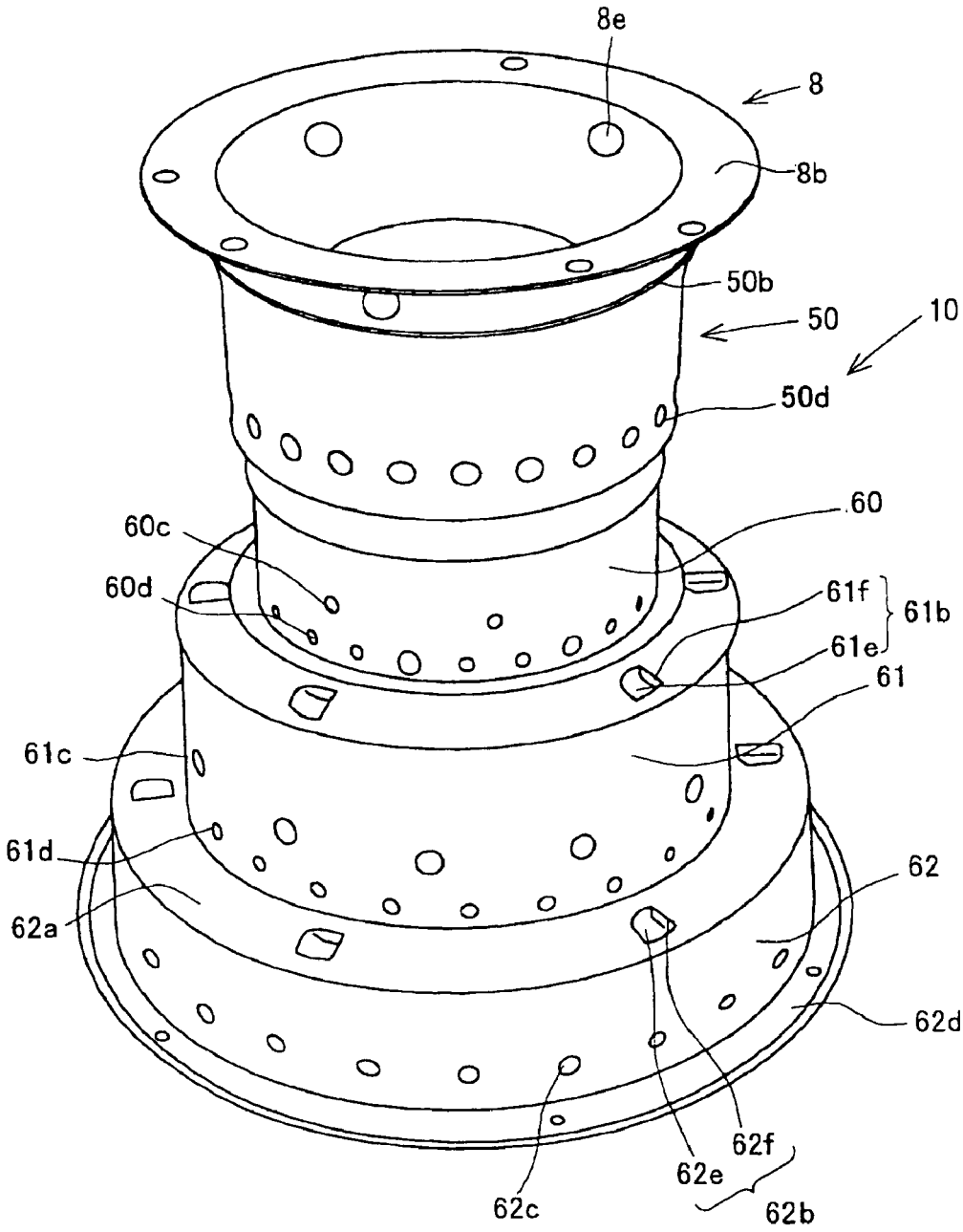
FIG. 7 is a perspective view of the combustion chamber of the apparatus shown in FIG. 1.

As shown in FIG. 7, the combustion chamber 10 is composed of three cylindrical members stacked one on another. The uppermost cylindrical member functioning as a first flaming section 60 does continue to the middle member functioning as a second flaming section 61, that in turn continues to the lowermost member functioning as a combustion cavity 62. The upstream end of such a combustion chamber 10 is in a pressed engagement with the primary air-intake cylinder 50 that continues upwards to the nozzle block 8. Thus, the combustion chamber 10, the air-intake cylinder 50 and the block 8 are made integral with each other and secured to the casing 7.

As also seen in FIG. 7, the second flaming section 61 is of a diameter larger than the first one 60 located on upstream side of the former 61. The combustion cavity 62 is of a diameter larger than the second flaming section 61 located on upstream side of said cavity 62. Such cylindrical members 60, 61 and 62 have their axes generally aligned one with another.

The first and second flaming sections 60 and 61 form a principal section in which the fuel jetting from the nozzle 12 will burn to form a standing flame. Thus, the second section 61 and its upstream side of this combustion chamber 10 do correspond to the so-called 'burner' portion. On the other hand, the combustion cavity 62 located downstreamly of and continuing from the second flaming section 61 provides a space in which the combustion gas produced in the first and second sections 60 and 61 flows downwards. Also in this cavity 62, any incompletely burnt fractions of the fuel having entered it will be allowed to burn completely.

As seen in FIG. 5, the first flaming section 60 has a generally closed top 60*e*, and as seen in FIG. 6, this top 60*e* faces the nozzle. Swirling inlets (as the air-revolving means) 60*b* formed in the closed top 60*e* and in centrifugal directions do surround a central opening 60*a* of the top 60*a*. Each swirling inlet 60*b* is formed by opening up a generally rectangular portion of said top downwardly to provide a vane 60*g* and a hole 60*f*. An air stream entering this section 60 through the hole 60*f* and along the vane 60*g* will swirl counterclockwise, when viewed downwards from the upstream side of this top.

A plurality of air holes 60*c* and other air holes 60*d* are formed in and all around the lower (downstream) zone of the peripheral wall of first flaming section 60. All the holes 60*c* and 60*d* function to keep the interior and exterior of this section in fluid communication with each other. The ambient air having flown in between the casing 7 and combustion chamber 10 will thus be allowed to transfer into the latter, through those air holes 60*c* and 60*d*.

An annular shoulder 61*a* facing upwards and intervening between the larger-diameter flaming section 61 and the smaller-diameter first one 60 serves to connect them together. Swirling inlets 61*b* (as the air-revolving means) formed in this shoulder 61*a* are made each by pressing downwards a portion of said shoulder so as to provide a hole 61*e* and air guide 61*f*. This air guide 61*f* will deflect into the hole 61*e* a portion of the air around the chamber 10, so as to form a distributary. The distributaries will advance along the inner surface of said shoulder and swirling around the axis of second flaming section 61, in the same direction as the air streams having entered the first flaming section 60.

A plurality of further air holes 61*c* and still further air holes 61*d* are formed in and all around the lower (downstream) zone of the peripheral wall of second flaming section 61. All the holes 61*c* and 61*d* function to keep the interior and exterior of this section in fluid communication with each other. The ambient air present outside the combustion chamber 10 will be allowed to enter the second section 61, through those air holes 61*c* and 61*d*.

Another annular shoulder 62*a* intervening between the largest-diameter combustion cavity 62 and the smaller-diameter second flaming section 61 serves to connect them together. Swirling inlets 62*b* (as the air-revolving means) also formed in this shoulder 62*a* are of substantially same shape and function as those of the swirling inlets 61*b* formed in the first-mentioned shoulder 61*a*. Each inlet 62*b* is made by pressing downwards a portion of said shoulder 62*a* so as to provide a hole 62*e* and air guide 62*f*. This air guide 62*f* will deflect into the hole 62*e* a portion of the air surrounding the combustion cavity 62, so as to form a distributary flowing into this cavity 62.

A plurality of yet still further air holes 62*c* are formed in and all around the lower (downstream) zone of the peripheral wall of combustion cavity 62. These holes 62*c* function to keep the interior and exterior of this cavity in fluid communication with each other. The downstream circular edge of said peripheral wall is bent radially and outwards to form a flange 62*d*.

Figure 8:
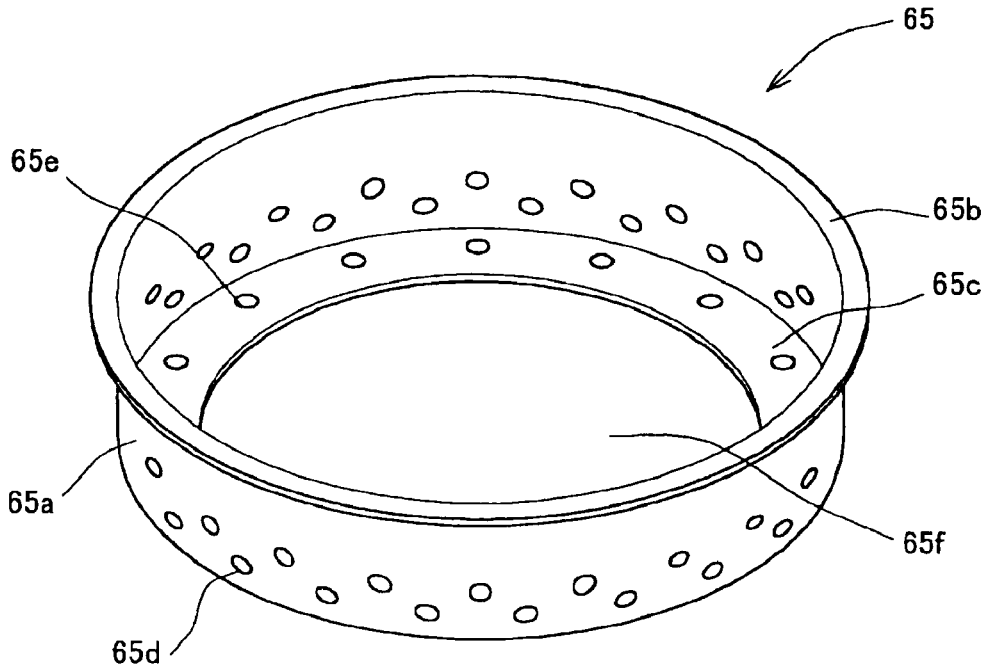
FIG. 8 is a perspective view of the anti-spreading member employed in the combustion apparatus of the embodiment shown in FIG. 1.

An anti-spreading member 65 (as an anti-spreading means) is of a cylindrical shape as seen in FIGS. 5 and 8. This anti-spreading member 65 having an open top and an open bottom does airtightly continue from the downstream edge of the combustion chamber 10, and is fastened (using an annular fastener 68 shown in FIG. 6) in position downstreamly outside the casing 7. Constituent portions of the anti-spreading member 65 is a cylindrical main body (formed as a peripheral wall) 65*a*, an outer flange 65*b*, and an inner flange (serving as the gas-staying member) 65*c* defining inside it an opening 65*f*. The main body 65*a* is a short-cylindrical member whose inner diameter is substantially the same as that of the combustion cavity 62 (as the lowermost part in combustion chamber 10 shown FIG. 6). The axial length of the main body 65*a* is smaller than the inner diameter of the main body 65*a* (as clearly seen in FIG. 8).

The main body 65*a* of the anti-spreading member 65 is the peripheral wall extending in the direction of sprayed fuel from the nozzle 12. Ventilative holes 65*d* are formed in and through the lower end portion of the main body 65*a*, at regular angular intervals. This lower end portion that is a downstream region of the interior of the main body 65*a*, will surround the tip end of a flame generated in the combustion chamber 10. The fuel, air and combustion gas all flowing into the anti-spreading member 65 will be ready for completion of the combustion process, so that portions of the fuel, air and flame will flow out radially through those holes 65*d*. The portion of fuel mist thus deflected sideways will be burnt to form flames around the main body 65*a* so as to merge into the tip ends of flames that have been produced in the combustion chamber 10 and are passing in part through those holes 65*d*.

The outer flange 65*b* formed by bending outwards an end of the main body 65*a* of the anti-spreading member 65, so that it is fixed on the bottom 66 of the casing 7. Thus, the anti-spreading member 65 continues smoothly from the combustion chamber 10.

The inner flange 65*c* formed by bending inwards another end of the main body 65*a* of the anti-spreading member 65, so as to extend substantially in a direction perpendicular to the axis of the cylindrical main body 65*a*. The inner flange 65*c* provides a constricted opening for the main body 65*a* of this member 65. It will be apparent that this inner flange 65*c* does function as a gas-staying member such that the fuel jetting into the combustion chamber 10 and running towards the downstream region thereof will be inhibited from further descending freely beyond said region.

The inner flange 65*c* ring-shaped in plan view has, formed therein, a plurality of further ventilative holes 65*e* also arranged at regular angular intervals. These holes 65*e* will function in the same manner as those 65*d* in keeping the interior and exterior of the anti-spreading member 65 in fluid communication with each other. The portions of the fuel, air, flame and combustion gas will flow out radially through those ventilative holes 65*e*, so that the portion of fuel mist having stayed in the anti-spreading member 65 will be burnt to form flames around this member.

The opening 65*f* is disposed at the downstream end of the anti-spreading member 65 and surrounded by the inner flange 65*c*. This opening 65*f* is narrower than the top or upstream opening formed inside the outer flange 65*b*. Thus, the inner flange 65*c* constricts the effective area of the downstream opening 65*f* of the main body 65*a*.

The primary air-intake cylinder 50 secured to the combustion chamber 10 is composed of an upstream larger-diameter portion 50*a* and a downstream portion 50*c* whose diameter is slightly smaller than the former portion 50*a*. The upstream portion 50*a* extends axially a height that is the major portion of the overall height of the air-intake cylinder 50. Formed in the downstream end region of the periphery of the upstream larger-diameter portion 50*a* are aspiratory holes 50*d* disposed all around the end region and at regular angular intervals. The upper circular edge 50*b* is flared slightly and outwards, and the inner diameter of the downstream portion 50*c* is generally equal to the outer diameter of the first flaming section 60 of combustion chamber 10.

The nozzle block 8 is a cylindrical member with a generally closed downstream bottom, and its upstream end is bent horizontally and outwards to form a flange 8*b*. A central opening 8*d* is formed in the bottom 8*c* centrally thereof, and a cylindrical body 8*a* of this nozzle block is slightly tapered to increase diameter towards the upstream end. However, a circular corner connecting the body 8*a* and the bottom 8*c* has a considerably large radius of curvature. Further aspiratory holes 8*e* are formed in the upstream end region of the cylindrical body 8*a*, also at regular angular intervals. The outer diameter of this body is substantially equal to the inner diameter of the larger-diameter portion 50*a* of primary air-intake cylinder 50.

The nozzle block 8 is made integral with the primary air-intake cylinder 50 in the manner of interference fit. In detail, the block 8 led by its bottom 8*c* will be placed in and then inserted deep into the upstream larger-diameter portion 50*a* of said cylinder. The upstream end 50*b* of primary air-intake cylinder 50 will be spaced a distance from the flange 8*b* of nozzle block 8 having inserted in this cylinder. This is because the cylindrical body 8*a* of nozzle block 8 is tapered as mentioned above, and such a state of these members will be seen in FIGS. 7 and 6.

The primary air-intake cylinder 50 thus fixed on the nozzle block 8 will then be inserted in the first flaming section 60 of combustion chamber 10 so as to become integral therewith. In this state, the central opening 8*d* of the nozzle block 8 is closely overlaid on the central opening 60*a* of the first flaming section 60. Thus, an integral and composite opening is provided for the sprayed mist to advance from said block 8 into said section 60.

The casing 7 is a box-shaped component that has a top 64 facing the bottom 66 as seen in FIG. 6. A large opening 66*a* formed in this bottom 66 has a periphery, from which a shielding cylinder 67 stands upright towards the upstream end or top of this casing.

The combustion chamber 10 placed in and firmly secured to the casing 7 takes a correct position therein. In detail, the nozzle block 8 and primary air-intake cylinder 50 are previously fixed on the combustion chamber 10, whose downstream end is inserted in the opening 66*a* of the casing's 7 bottom 66. On the other hand, the flange 8*b* of the nozzle block 8 bears against the top 64 of said casing 7. The flange 62*d* of combustion cavity 62 as the lowermost section of combustion chamber is fitted in the shielding cylinder 67 protruding up from the bottom of casing 7, thus accurately positioning the combustion chamber 10 therein.

Secured to a rear face of the bottom 66 of the casing 7 is the anti-spreading member 65. The annular fastener 68 shown in FIG. 5 fixes this member 65 to the outer face of casing 7, so that the ambient air fed into the casing will not directly contact the member 65. Its outer flange 65*b* is secured to the outer face, with its inner flange 65*c* being located downstreamly of the sprayed fuel. The fastener shown in FIG. 5 is ring-shaped to have an annular shoulder 68*a*, that is intended to engage with the outer flange 65*b* of the anti-spreading member 65 before detachably setting the fastener 68 in position on the bottom 66 using fastening pieces such as screws.

Now, the flow of air and the forming of a flame in the apparatus of the embodiment will be described with reference to FIG. 6.

A portion of the air fed by the blower 11 into the casing 7 will enter the nozzle block 8 through its aspiratory holes 8*e*. Another portion of the air fed by the blower 11 will enter the primary air-intake cylinder 50 through its aspiratory holes 50*d*. The another portion of ambient air will then run through a narrow clearance between the nozzle block 8 and air-intake cylinder 50, so that it passes through the swirling inlets 60*b* into the first flaming section 60. The another portion of air thus forming a swirling stream does enter the combustion chamber 10, so as to be consumed as the primary air. Such a swirling air stream will join the air coming from the aspiratory holes 8*e*, so that they are mixed with the fuel mist sprayed out from the nozzle 12 and inflamed within the first flaming section 60 and near its central opening 60*a*.

Other portions of the ambient air introduced into the casing 7 will form distributaries, some of them flowing into the combustion chamber 10 through the aspiratory holes 60*c* and 60*d* of first flaming section 60. The other air distributaries will flow into the chamber 10 through the aspiratory holes 61*c* and 61*d* of second flaming section 61, and the remainder of such distributaries will enter said chamber 10 through the aspiratory holes 62. These distributaries will be used as a whole as the secondary air necessary to burn the fuel.

Another portion of the air fed to the casing 7 will flow into the combustion chamber 10, through the swirling inlets 61*b* that are formed in the annular shoulder 61*a* disposed between the first and second flaming sections 60 and 61. Air streams from those inlets 61*b* will advance along and closely to the inner periphery of the second flaming section 61, thus swirling therein. The fuel sprayed into the chamber 10 and the air having been introduced into it through the aspiratory holes 60*c*, 60*d*, 61*c* and 61*d* will be stirred well by such swirling air streams effluent inwards through the inlets 61*b*. The fuel sprayed into the combustion chamber 10 will thus be burnt almost completely.

Still another portion of the air fed to the casing 7 will be introduced into the combustion cavity 62, through the swirling inlets 62*b* that are formed in the other annular shoulder 62*a* disposed between the second flaming section and this cavity 62. Air streams from these inlets 62*b* will advance along and closely to the inner periphery of this cavity 62, thus swirling therein. The incompletely burnt fractions of fuel sprayed into the chamber 10 and the air having entered it through the aspiratory holes 62*c*, will be stirred well by such swirling air streams effluent inwards through the inlets 62*b*. The fuel sprayed into the combustion chamber 10 will thus be burnt almost completely.

Combustion of the fuel sprayed into the combustion chamber 10 will raise the internal pressure thereof above that which will be observed in the anti-spreading member 65. Thus, the main body 65*a* of this member 65 disposed downstreamly of said chamber 10 will smoothly receive the residue of fuel not burnt within the chamber 10 as well as the gas as the product of combustion. In a case wherein the required heat generation rate is considerably high, the flame standing in the chamber 10 is prone to reach the interior of the anti-spreading member 65.

The inner flange 65*c* located at the downstream end of the anti-spreading member 65 does extend in a direction perpendicular to the direction of fuel sprayed from the nozzle 12. By virtue of such a structure of the anti-spreading member 65, both the residual fuel and the hot combustion gas will be stopped in part by the flange 65*c* so as to stay for a while in the main body 65*a* of this member 65.

A portion of the flame and combustion gas that have been produced in the combustion chamber 10 and have flown in the anti-spreading member 65 will flow out of this apparatus, beyond its downstream end, through the opening 65*f*. The remainder of such flame and gas will flow sideways through the ventilative holes 65*d* of the main body 65*a*, or straightly through the other ventilative holes 65*e* of the inner flange 65*c*, anyway leaving the anti-spreading member 65.

The main body 65*a* of this anti-spreading member 65 shows a considerably raised temperature due to heat of the flame and hot combustion gas. Thus, the residue of fuel staying within this anti-spreading member 65 will surely be heated by the hot combustion gas and/or by the hot wall surface of this member 65, so as to vaporize and almost completely burn. The mixture of such a reside of fuel and the air will also leave the member 65 through the ventilative holes 65*d* and 65*e* noted above, thereby forming flames jutting therefrom in any direction.

In contrast with the combustion chamber 10 installed in the casing 7, the anti-spreading member 65 is disposed outside this casing so that air from the blower 11 will not cool the member 65, thus the member 65 is smoothly heated.

Owing to such a location of the anti-spreading member 65, it will not undergo any undesirable influence due to the air flow from the blower 11, but will maintain an optimum balance between its internal pneumatic pressure and the barometric pressure.

Difference in pressure between the interior and exterior of the anti-spreading member 65 is smaller than that which will be found with respect to the combustion chamber 10. Contrarily to this chamber 10 receiving inward air streams from the interior of casing 7 to which the ambient air is being supplied, no such inward air streams take place around and within the anti-spreading member 65. Instead combustion gas from the chamber 10 will dash into this member 65, so that the other combustion gas and flame produced therein are forced to jet outwards through the ventilative holes 65*d* and 65*e*. Thus, the flame initially produced in the chamber 10 will expand in a plane around the anti-spreading member 65.

Such an expansion of the flame in the said plane will make it possible to reduce the distance by which the target article to be heated is located away from the combustion apparatus 2. This feature is beneficial in rendering smaller in size any composite utility apparatuses that may have this apparatus 2 built therein as a heat source.

As described above, the combustion chamber 10 is composed of the first and second inflaming sections 60 and 61 and the combustion cavity 62 that are connected to each other to increase the diameters of their central openings in this order. These sections and cavity continue one to another in a stepwise fashion in the direction spraying the fuel so as to be generally in harmony with the pattern of the fuel sprayed. Temperature distribution in the chamber 10 is thus minimized, so that none of the fuel portions or fractions sprayed or otherwise brought into any zone of said chamber will not show any aggregation, but will burn smoothly.

As the combustion chamber 10 has a shape generally in harmony with the pattern of the stream of fuel being sprayed, the fuel portions or fractions sprayed or otherwise brought into any zone of said chamber will be mixed well with the air streams flowing inwards through aspiratory holes 60*c*, 60*d*, 61*c*, 61*d*, and 62*c* formed through the chamber 10, thereby being burnt completely.

The swirling inlets 60*b*, 61*b* and 62*b* formed in the shoulders of the combustion chamber 10 serves to supply it with swirling air streams. Thus, all the portions or fractions of fuel sprayed into this chamber 10 will be stirred well by such swirling air streams to be burnt completely.

The fuel sprayed will be burnt almost entirely and completely in the apparatus of the invention. However, any sudden disturbance such as unexpected variation in the introduced amount of ambient air would tend to produce byproducts such as soot tending to accumulate on the shoulders 61*a* and 62*a*. The air revolving means, i.e., the swirling inlets 61*b* and 62*b*, will continuously provide the swirling air streams sweeping and cleaning up the shoulders, removing byproducts such as soot therefrom. Neither unsmooth combustion nor damage of the apparatus 2 will not take place in the apparatus 2 of the invention.

Portions of the flame being formed in the combustion chamber 10 will be allowed to flow out of the anti-spreading member 65 through the ventilative holes 65*d* and 65*e*. Any residue of fuel incompletely burnt will be after-burnt in the anti-spreading member 65, forming additional flames through these holes 65*d* and 65*e*. The outer periphery of this member 65 will be surrounded closely with such additional flames. Thus, the main flame originating from the combustion chamber 10 will not extend excessively and longitudinally thereof but rather tend to expand transversely thereof in a plane perpendicular to the anti-spreading member 65 disposed downstream of the chamber 10.

The fuel canal 13 which the apparatus 2 involves is composed of the feed canal 16 for feeding the fuel from the tank 15 to the nozzle 12 and a return canal 17 for returning a portion of the fuel away from this nozzle 12 towards the tank 15. Disposed in the feed canal 16 are the electromagnetic pump 18, electromagnetic valve 20 and check valve 21, arranged in this order, with the pump 18 being disposed nearest the tank 15. Disposed in the return canal 17 are the temperature sensor 22, check valve 23, accumulator 26 and injector valve 25, arranged in this order, with the sensor 22 being disposed nearest the nozzle 12. The downstream side of injector valve 25 of the return canal 17 merges into the feed canal 16 at its portion between the tank 15 and pump 18.

Both the feed and return canals 16 and 17 are checked doubly by two parts built in them. In detail, the electromagnetic valve 20 and check valve 21 do check the flow through the feed canal 16. The other check valve 23 and injector valve 25 are the two parts for checking the other flow through the return canal 17. Thus, any leakage of fuel will not occur between the regions of each canal 16 or 17.

The injector valve 25 in the return canal 17 does show the strongest checking performance ability such that the fuel would not be allowed at all to flow into the feed canal 16. Consequently, the region of the return canal 17 between the check and injector valves 23 and 25 may suffer from an extreme internal pressure, possively to be broken or damaged. The accumulator 26 interposed between these valves 23 and 25 will however relieve such an extreme pressure and protect them from damage.

The combustion chamber 10 thus increasing diameter towards its distal end is shaped in conformity with configuration of the stream of mist sprayed from nozzle 12. No noticeable quantity of fuel will not adhere to the inner surface of combustion chamber 10, and no remarkable gap will appear between this surface and the periphery of a flame produced during the combustion process.

The fuel being sprayed from the nozzle 12 will thus spread evenly throughout the combustion chamber 10, whereby combustion heat will be distributed to the chamber's wall and the interior of chamber also uniformly. Temperature distribution throughout this chamber 10 is now rendered so uniform that almost all the fuel particles sprayed from nozzle 12 will be completely burnt, without suffering from aggregation of them.

As noted above, the gap between the combustion chamber wall 10 and the flame is reduced and a sufficient amount of ambient air is introduced into the chamber through the air holes 56 and 57. Thanks to these structural features, the fuel sprayed into and flaming in said chamber is intermixed well with the ambient air so as to ensure complete combustion.

As also noted above, both the feed canal 16 to and the return canal from the spraying nozzle 12 are capable of being shut with two valves, that is, valves 20 and 21 or valves 23 and 25. Thus, the fuel tank 15 can be sealed tightly against these canals, whenever so required.

An inter-valve zone 'A' present between injector valve 25 and check valve 23 may tend to show a high pressure to injure either of these valves, because of a tightly closing nature of the injector valve 25. However, the accumulator 26 disposed in the return canal 17 and absorbing such a high internal pressure will effectively protect them from damage.

The related art fuel pipe line 209 in a combustion apparatus necessitates two or more electromagnetic valves, but they are usually expensive, bulky and cause waste of electric energy. In contrast, the fuel pipe line 13 forming the combustion apparatus 2 of the invention has only one electromagnetic valve 20 installed therein in combination of two check valves 21 and 23 and one injector valve 25. Thus, the present apparatus is rendered more compacted and capable of being manufactured inexpensively and operating with a reduced consumption of electric power, thus resolving all the drawbacks inherent in the related art apparatuses.

As the electromagnetic pump in the feed canal 16 discharges fuel in constant pressure, flow rate of fuel supplied to the spraying nozzle is quite constant. The injector valve 25 employed herein and disposed in return canal 17 does cooperate with the single electromagnetic valve 20 of feed canal, in a very preferable manner. The opening and closing of the former valve 25 is repeated fast and frequently at every instant, with the latter valve 20 constantly discharging the fuel, so that it will be sprayed at any accurate and desired rate from the spraying nozzle 12 into the combustion chamber 10 in a highly stable fashion. Thus, the fuel well mixed with ambient air within this chamber will exactly and efficiently produce a required amount of heat, without giving rise to any material loss of the fuel fed to the nozzle.

Stable and complete combustion of fuel in the apparatus 2 will minimize the amount of carbon monoxide or the like toxic gases and soot which incomplete combustion has been producing, thereby diminishing environ-mental pollution and breakdown of apparatus.

Next, control of the combustion apparatus 2 of the present invention will be described. The controller 40 comprises at its principal part a CPU designed to control various devices included in this apparatus, such as the injector valve 25, blower 11, electromagnetic pump 18, damper 58, etc. The injector valve 25 in the return canal 17 will be controlled by the method of duty-ratio control so as to regulate the flow rate of returning fuel as well as the spraying rate thereof at the nozzle 12, thus adjusting the combustion process.

Written in the CPU of controller 40 are programs to control the operation of apparatus 2, as will be detailed below. Upon issuance of demand for combustion, the controller 40 will hold open the injector valve 25 for a given time. Thus, the internal pressure of fuel pipe line is relieved and lowered generally to the level of barometric pressure, thus effecting a pre-combustion relief of pressure.

Subsequent to the pre-combustion relief, a preheating process will be conducted in the apparatus 2 under control by the controller 40. This preheating process may consist of a plurality of steps (two steps in the present embodiment). At the first preheating process, the fuel will be sprayed and burnt at a certain reduced flow rate corresponding to a heat generation rate lower than the required heat generation rate 'Q' of said fuel. At the second preheating process, the flow rate will be raised to a higher level as will be discussed below.

In detail, the pump 18 will be activated to feed the fuel to the nozzle 12 at the reduced rate that corresponds to a heat generation rate 'q' lower than the required one 'Q'.

At an initial phase of the first preheating process, the controller 40 will order the pump 18 to carry out a preliminary operation to temporarily modify its discharge pressure. This pump 18 during this phase has to perform a heavier duty than is needed for the heat generation rate 'q'. The reason for conducting such a preliminary operation is that a certain time lag is inevitable for the pump 18 until its output reaching a level meeting the said heat generation rate 'q'. Therefore, if any countermeasure were not taken in the first preheating process, then the spraying rate and the condition of combustion would probably be rendered not steady. The preliminary operation to temporarily modify the pump's 18 output level will thus effective to avoid such an inconvenience and render reliable the ignition and combustion during the first preheating process.

The second preheating process is generally addressed to a case wherein the required heat generation rate 'Q' is higher than a reference rate 'Z'. In this case, the blower 11 will operate at a reduced rotational speed during the heating of the anti-spreading member 65. Upon accomplishment of such a second preheating process, normal operation of the apparatus 2 will start, with the injector valve 25 being adjusted as to its duty ratio to match the required rate 'Q'.

After combustion process, the blower 11 will be driven further for a given time to exhaust residual combustion gas, simultaneously with the post-combustion pressure relief step carried out by keeping open the injector valve 25 for a time. This is because the residual fuel portion not having burnt but flowing back from nozzle 12 into the return canal 17 will still be at a considerable pressure, due to the pump 18 having compressed the successive amounts of fuel in its entirety towards said nozzle. If the injector valve 25 would otherwise be closed at the same time as termination of that combustion process, then the residual fuel will raise internal pressure of the return canal 17, which might render non-durable the devices communicating with this canal.

Figure 9:
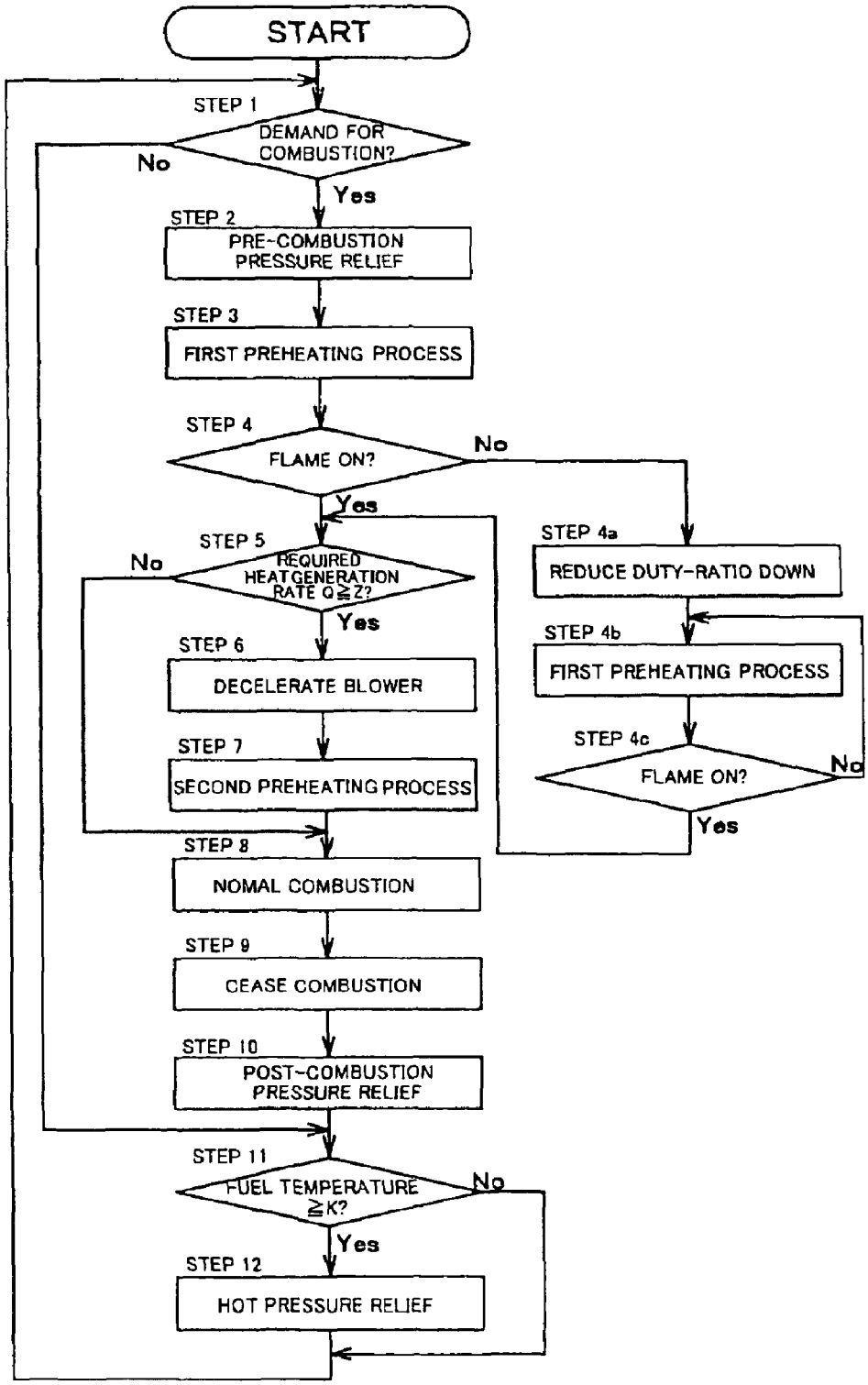
FIG. 9 is a flow chart showing the operation of combustion apparatus shown in FIG. 1.
Figure 10:
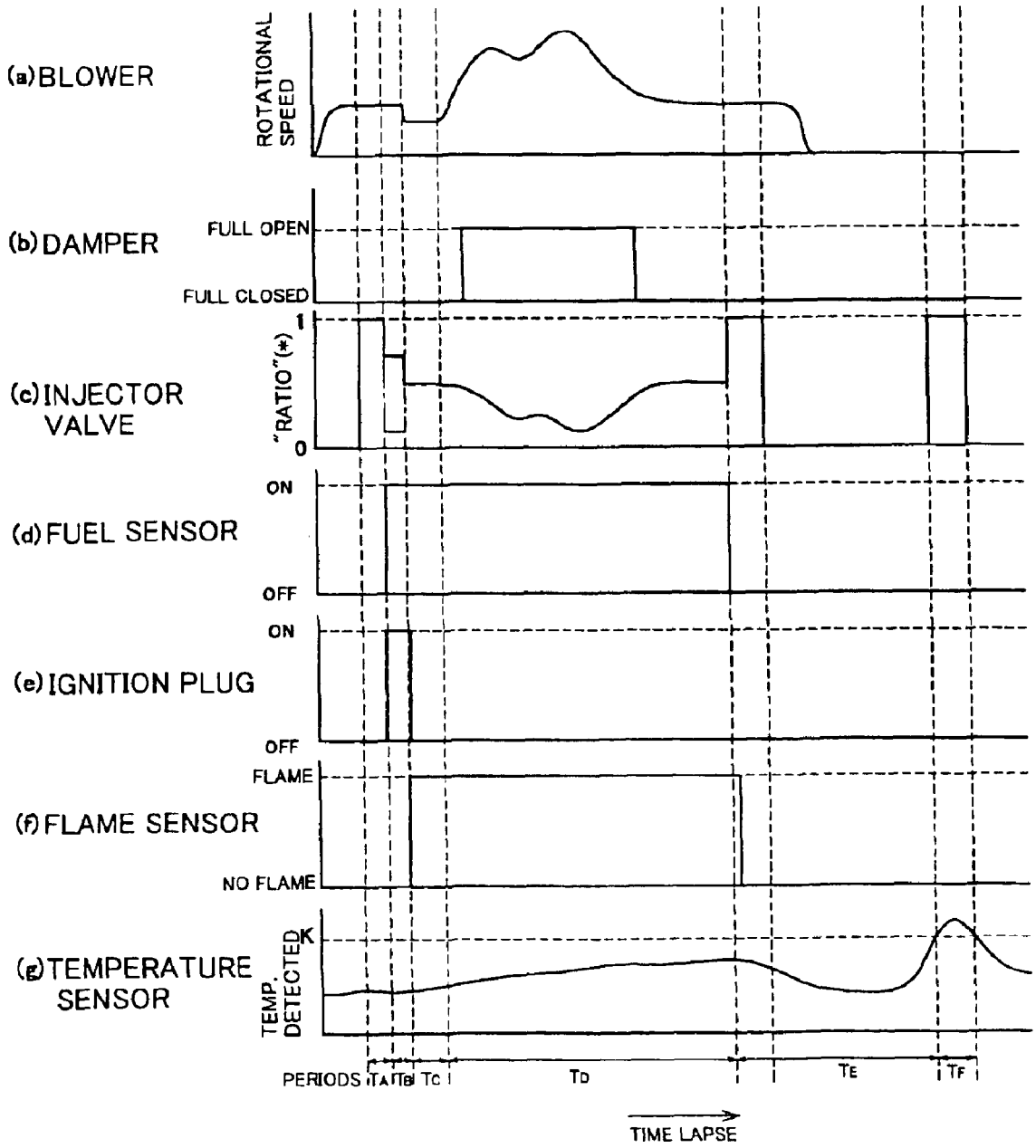
FIG. 10 is an array of time charts showing the operations of constituent parts of said apparatus of FIG. 1, in which the time chart (a) represents the operation of a blower, the chart (b) representing the operation of a damper, the chart (c) representing the operation of the injector valve, the chart (d) representing the operation of the fuel pump, the chart (e) representing the operation of an ignition plug, the chart (f) representing the operation of a flame sensor, and, the chart (g) representing the change in the course of time of the temperature detected using a temperature sensor.
Figure 11:
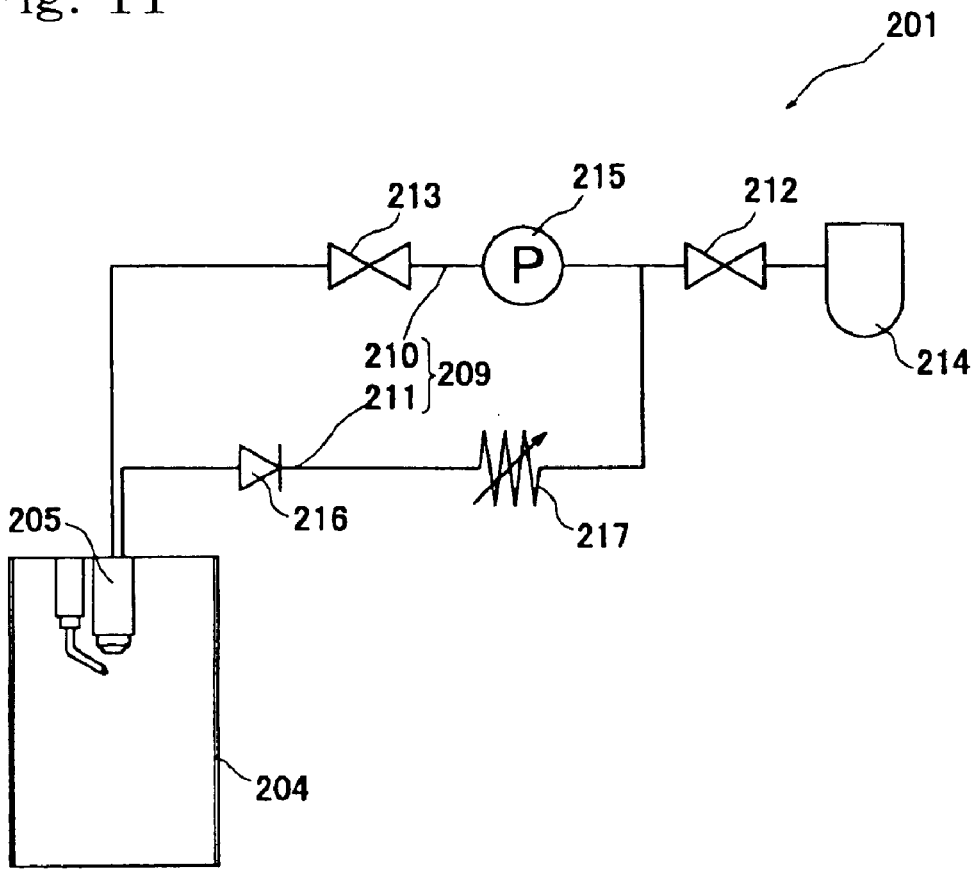
FIG. 11 is a scheme of the related art combustion apparatus.
Figure 12:
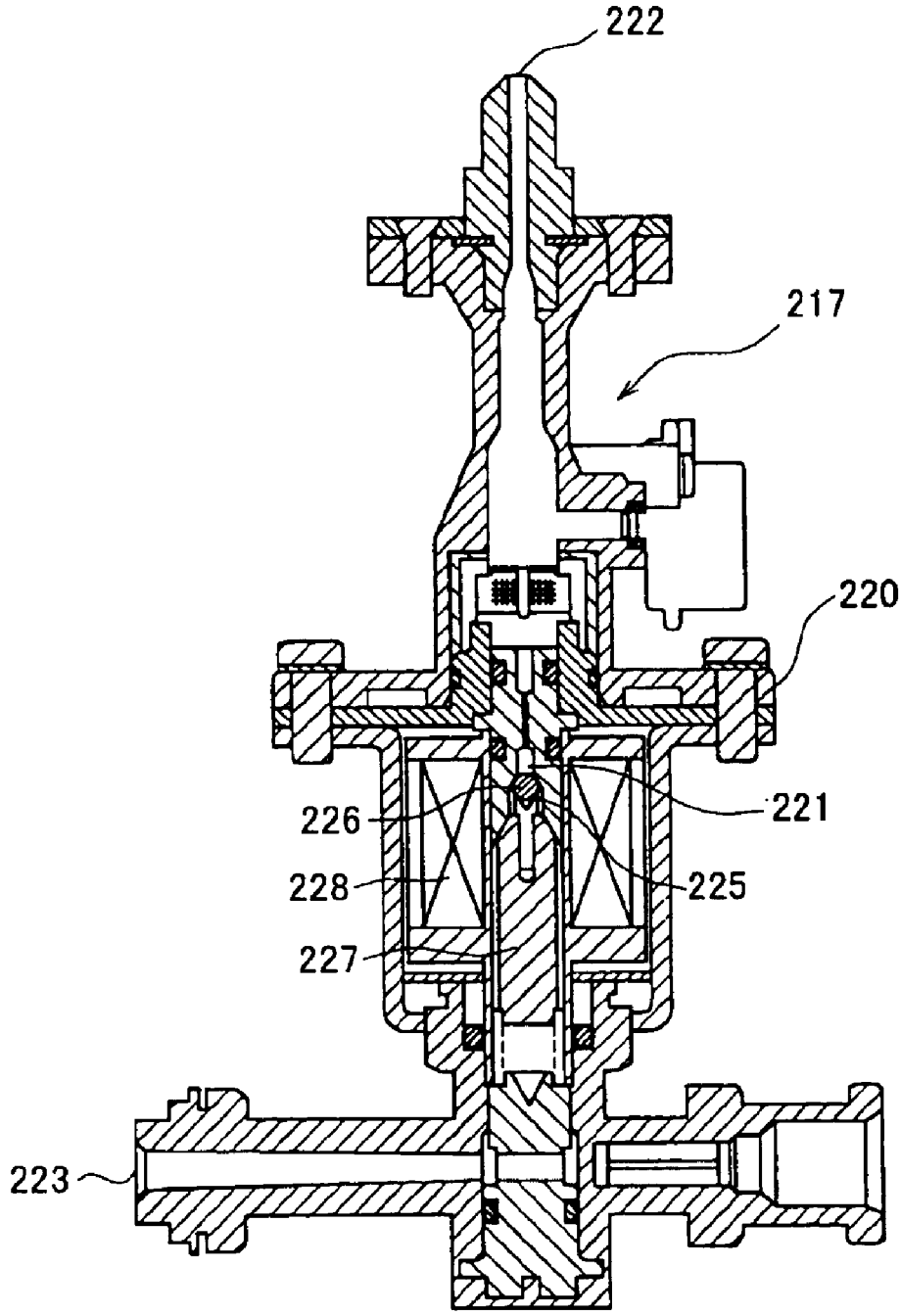
FIG. 12 is a cross section of a proportional control valve employed in the related art apparatus.

Details of operation of the combustion apparatus of the invention are as follows and as illustrated in FIGS. 9 and 10, in which FIG. 9 is a flow chart and FIG. 10 is a time chart corresponding thereto.

With a main switch (not shown) being turned on, the controller 40 will make at the step-1*a* judgement as to whether any demand for combustion for apparatus 2 is then present or not. If affirmative, then the process advances to step-2, but if negative, the process will skip to step-11.

The blower 11 will be activated at step-2. At this step, the pre-combustion pressure relief is also carried out for the fuel canal connected to nozzle 12, by keeping open for a period $T_A$ the injector valve 25, prior to the first preheating process at step-3.

The first preheating process will be done by operating the apparatus 2 at the temporary heat generation rate 'q' lower than the required rate 'Q'. For this purpose, the pump 18 will be switched on as indicated by a succeeding period $T_B$ shown in FIG. 10. At the same time, duty ratio of injector valve 25 will be adjusted by means of the controller 40 so as to make the spraying rate lower than that necessary for the required heat generation rate 'Q' of combustion. Also simultaneously, the blower 11 will be put into operation by means of the controller 40, with the damper 58 being kept closed to isolate the first space 56 of the interior of casing 7 from the second space 57 thereof. The ambient air thus introduced into the first space 56 will then enter the combustion chamber 10 so as to be mixed with the fuel sprayed into this chamber, thereby enabling ignition of fuel to start the first preheating process.

By virtue of the preliminary and temporary modification of the pump's discharge pressure, made in view of the time lag as mentioned above, this pump 18 will quickly stabilize its output pressure, to smoothly start combustion of fuel at the initial stage of the first preheating process.

Done at the step-4 is a further judgment on whether the sensor 52 is or is not detecting a flame. If negative, then it may be supposed that any amount of air has been entrained in the fuel flow, disabling the pump 18 to suck the fuel out of the tank 15 and propel it sufficiently through the feed canal 16 towards the nozzle 12. For example, such an entrained air would have rendered the fuel portion in the return canal 17 much easier to be sucked by the pump 18, than is the other fuel portion staying in the feed canal and upstreamly of this pump. In such an event suggesting failure in surely spraying fuel into combustion chamber 10, the process should go to step-4*a*.

In order to resolve this problem, the duty ratio of injector valve 25 will be lowered to decrease the ratio of overall duration of its open state per unit time. As a result, the fuel portion residing in the return canal is made more resistant to the sucking of it by the pump 18, that will thereafter suck the fuel more strongly from the tank 15 through the feed canal 16 directly connected thereto.

Following the step-4*a*, the first preheating process will be done again at the step-4*b*, before a still further judgment is made at step-4*c* as to whether a flame is or is not being detected by the sensor 52. If affirmative, the process advances to step-5, but if negative, then it will return to step-4*b* to repeat the first preheating process.

A yet still further judgement will be performed at the step-5 as to whether the required heat generation rate 'Q' for the apparatus 2 is or is not equal to or higher than the reference rate 'Z'. If affirmative, then the process transfers to step-6 and then step-7, in order to conduct the second preheating process of the anti-spreading member 65.

If a negative result is obtained at step-5, then the process skips to step-8, without conducting such a preheating process. In this case of 'Q' lower than 'Z', the combustion flame and any residual gaseous fuel not burnt will seldom reach the downstream end (lower end in FIG. 1) of the combustion chamber 10. Thus, they will seldom cooled due to contact with the anti-spreading member 65, thus little amount of hydrocarbons will be produced from the scarcely cooled flame. Further, any portion of gaseous fuel that has not burnt in but is passing the chamber 10 will not be cooled to liquefy, thus unnecessitating the second preheating at step-6 and step-7.

If the affirmative result is obtained for the judgment at step-5, as noted above, then the flame and fuel portion will possibly reach the downstream end of combustion chamber 10 and be cooled by the anti-spreading member 65. The rotational speed of blower 11 will therefore be lowered by means of the controller 40 for a time (as indicated at (a) in FIG. 10) in order to protect the chamber 10 from being cooled with the ambient air. In this state, the feed rate of ambient air will be at the lowest level indispensable to complete combustion. Subsequently, the anti-spreading member 65 will be subjected to the second preheating process, at step-7.

In the second preheating process at step-7, the duty ratio will be modified as shown for period $T_C$ in FIG. 10. This ratio as the frequency of opening and closing the injector valve 25 is decreased in order to increase the actual effective flow rate of the fuel being sprayed. Thus, heat generation rate in the second preheating process will be higher than that in the first preheating process, but not higher than the required heat generation rate 'Q' of combustion.

A flame formed by the second preheating process at step-7 is larger than that formed by the first preheating process, so that the tip end of the former will extend beyond the downstream end of chamber 10 and reach the anti-spreading member 65. In general, the flame formed in the apparatus 2 runs along and close to the inner periphery of the chamber 10 and the anti-spreading member 65, so that the latter will be heated by thermal radiation from such a flame. Additionally, the reduced flow rate of air supply as controlled at step-6 will facilitate the anti-spreading member 65 to be heated more.

As noted above, in the case of required heat generation rate 'Q' equal to or higher than reference 'Z', the second preheating process at step-7 will continue to normal operation commenced at the next step-8. In the other case of the required rate 'Q' lower than reference 'Z', the normal operation will directly follow the judgment at step-5, provided that flame has been detected. During the normal operation of the apparatus 2 conducted at step-8 and as shown in the period $T_D$ in FIG. 10, the frequency of opening and closing the injector valve 25 will be regulated from time to time in response to the varying required rate 'Q' of combustion. Simultaneously with such a regulation, rotational speed of blower 11 will also be adjusted, by adjusting the open area of the damper 58, so that a sufficient amount of ambient air necessary to complete combustion is supplied to each portion, zone or region of the chamber 10.

If and when the demand for combustion is regarded as having ended, then the process will immediately go to step-9 where the operation of pump 18 is stopped as shown in the period $T_E$ in FIG. 10. Thus, the spraying of fuel into the combustion chamber 10 will be ceased, with the blower 11 continuing its operation for a while for the sake of exhaustion of residual combustion gas.

As noted above, the fuel portion returning from nozzle 12 into the return canal 17 is the remainder of compressed fuel fed from pump 18 to nozzle 12. Such a compressed fuel might injure the injector valve 25 and the other devices if this valve is closed simultaneously with termination of combustion.

In view of such a possibility, the valve 25 will be kept open for a given time to relieve the remaining pressure of residual fuel at the step-10 for the purpose of post-combustion relief. In detail, the duty ratio of valve 25 will be shifted to the value "1.0", this meaning the full open state of this valve as seen in the period $T_E$ in FIG. 10.

After the completion of the post-combustion relief of pressure, the sensor 52 will detect fuel temperature in the return canal 17. If this temperature is judged to be above a limit 'K' critical to thermal expansion of fuel as seen in the period $P_F$ in FIG. 10, then the process goes to step-12 where the valve 25 is further kept open also for a given time. This step is called herein "hot pressure relief", that may not be done if the temperature detected by sensor 52 at step-11 is judged not to be above the limit 'K'. In this case, the process will directly return to step-i as shown in the flow chart of FIG. 9.

In summary, the anti-spreading member 65 is heated before normal operation of combustion apparatus 2, with a reduced amount of air so as to generate an extreme temperature effectively heating the member 65 located at the downstream end of combustion chamber 10. Thus, even in an initial stage of combustion, the residual fuel sprayed in the chamber as well as the combustion gas will not be cooled with the anti-spreading member 65 to liquefy.

The preheated anti-spreading member 65 will gasify again any fraction or portion of the fuel having liquefied or being liquefying when reaching the member 65. This anti-spreading member 65 located adjacent to the combustion chamber 10 will remain heated well during normal combustion process.

The inner flange 65*c* formed at the downstream end of the main body 65*a* of said member 65, so that hot combustion gas will remain for a while in this body 65*a* to keep it at elevated temperatures. Such a hot anti-spreading member 65 will prevent liquefaction of the gaseous fuel remainder having flown through chamber 10, thus facilitating complete combustion of fuel.

The first preheating process precedes the second preheating process, which in turn precedes normal operation, thus avoiding sudden change of amount of fuel being burnt and smoothing transfer between these phases.

If the apparatus fails in ignition at the first preheating process, the overall open period of injector valve 25 will be shortened. The suction resistance thus increased of the return canal will be effective to sufficiently take the fuel out of tank 15, preventing failure in ignition.

The flame from the chamber 10 expands in a plane around the anti-spreading member 65 and perpendicular to the spraying direction. Thus, any target is heated uniformly to improve thermal efficiency.

Such a shortened flame will advantageously reduce the distance between this apparatus 2 and any target such as a heat exchanger, facing the apparatus, thus making smaller in size the composite equipment such as a hot water supplier or the like.

The fuel having been sprayed into the apparatus will now be burnt almost completely, diminishing the amount of toxic gases such as carbon monoxide, hydrocarbons and other residues. Thermal efficiency is now enhanced, protecting well the environment from pollution.

Thanks to complete combustion now afforded herein, any damage resulting from soot accumulating in the apparatus will be avoided.

The anti-spreading member 65 need not consist of the main body 65*a*, outer flange 65*b* and inner flange 65*c*, but may be modified in any fashion provided that it involves the main body 65*a*. The said three portions may be manufactured discretely and assembled later to form an integral member.

The anti-spreading member 65 may not be of a cylindrical shape.

The ventilative holes 65*d* may not necessarily be formed in and all around the downstream end region of the member 65 at the shown regular intervals. They may be modified as to their position and density taking into account the flows of fuel and air and the state of flames jutting from such holes.

Either of or both the ventilative holes 65*d* in the main body 65*a* and those 65*e* in inner flange 65*c* may be dispensed with herein.

The outer flange 65*b* of the anti-spreading member 65 may not be fixed to bottom 66 of casing 7, but be soldered to downstream end of chamber 10.

The inner flange 65*c* of the member 65 may not be perpendicular to the main body 65*a*, but be conical to reduce diameter towards downstream end.

The three stepwise sections that is the first and second flaming sections 60 and 61 and combustion cavity 62 may be replaced by a conical structure or a two-step structure increasing diameter toward downstream end. The partition 55 dividing the casing's interior into two spaces, as well as the damper 58 formed in partition to change the air flow, may be dispensed with herein.

The anti-spreading member 65 may not be preheated, but any target likely to cool fuel and flame during combustion process may be preheated.

All or any of the second and first preheating, pre-combustion and post-combustion relief and hot pressure relief, and the pressure justification at the initial stage of first preheating in hot water supplier, may not be necessary.

The duty ratio for injector valve 25 at the first preheating process is higher than that at second preheating process, in view of the heat generation rate at these processes (see the periods $T_B$ and $T_C$ in FIG. 10). However, the capacity of the accumulator 26, the diameter of portions of the piping and/or other factors may possibly reverse the relationship between the duty ratio of injector valve and the spraying rate of nozzle. In such a case, the duty ratio at the first preheating process may be made smaller than that at the second preheating process, as shown with the dash-and-dot in the chart (c) in FIG. 10.

The combustion apparatus 2 described above is merely an embodiment of the present invention, and does never delimit the scope thereof.

What is claimed is:

1. A combustion apparatus comprising:

a spraying means for spraying a fuel to form a fuel mist stream, a combustion chamber designed to burn therein the fuel mist stream to form a flame, a fuel channel through which the fuel flows, and an anti-spreading means disposed at a downstream region of the combustion chamber so as to inhibit the fuel mist stream and the flame from freely spreading radially and outwardly out of the downstream region, wherein the anti-spreading means is capable of being preheated prior to combustion carried out in the combustion apparatus, wherein the anti-spreading means has a downstream end and near its downstream end a gas-staying member with a radially extending wall in which a constricted outlet opening is defined.

2. The combustion apparatus as defined in claim 1, wherein the anti-spreading means is preheated if a required amount of heat generated per unit time is equal to or exceeds a predetermined limit.

3. The combustion apparatus as defined in claim 1, wherein the anti-spreading means is preheated by increasing in a stepwise manner a feeding rate of the fuel being fed to the spraying means.

4. The combustion apparatus as defined in claim 1 that is capable of reducing flow rate of air into the combustion chamber while the anti-spreading means is preheated.

5. The combustion apparatus as defined in claim 1, wherein the anti-spreading means is preheated increasing stepwise a feeding rate of the fuel being fed to the spraying means, and if a failure in ignition happens when starting the preheating of the anti-spreading means, then the feeding rate will be raised to a higher average rate.

6. The combustion apparatus as defined in claim 1, wherein the anti-spreading means has a wall extending in a direction of the mist stream and smoothly continuing from the combustion chamber.

7. The combustion apparatus as defined in claim 1, wherein the anti-spreading means has a plurality of ventilative holes formed through the anti-spreading means such that the interior and the exterior of the means communicate with each other through the ventilative holes.

8. The combustion apparatus as defined in claim 1, further comprising an intermittently operating valve disposed in the fuel channel, wherein the intermittently operating valve is capable of being opened and closed periodically under the duty-ratio control conducted in response to the required amount of heat generated per unit time.

9. The combustion apparatus as defined in claim 1, wherein the fuel channel comprises a feed channel leading to the spraying means and a return channel for returning a portion of the fuel once forwarded to the spraying means, with an intermittently or periodically operating valve being disposed in the return channel.

10. A combustion apparatus comprising:

a spraying means for spraying a fuel to form a fuel mist stream, a combustion chamber designed to burn therein the fuel mist stream to form a flame, a fuel channel through which the fuel flows, and an anti-spreading means disposed at a downstream region of the combustion chamber so as to inhibit the fuel mist stream and the flame from freely spreading radially and outwardly out of the downstream region, wherein the anti-spreading means has a downstream end region and near its downstream end region a gas-staying member for radially constricting an outlet opening of the combustion chamber so as to cause a portion of the fuel sprayed into the chamber to stay for a while in the anti-spreading means.

11. The combustion apparatus as defined in claim 10, further comprising a casing to enclose the combustion chamber so as to form a semi-closed space around the chamber, so that the anti-spreading means is connected to an outer end face of the casing.

12. The combustion apparatus as defined in claim 10, further comprising:

a casing to enclose the combustion chamber so as to form a semi-closed space around the chamber, so that the anti-spreading means is connected to an outer end face of the casing, and an air-blowing means connected to the casing so as to introduce air into the casing.

13. The combustion apparatus as defined in claim 10, further comprising a casing to enclose the combustion chamber so as to form a semi-closed space around the combustion chamber, with the casing having an air-distribution adjuster so as to adjust a ratio of an air flow rate into an upstream region of the interior of the combustion chamber to another air flow rate into a downstream region of the interior of the combustion chamber.

14. The combustion apparatus as defined in claim 10, further comprising a casing to enclose the combustion chamber so as to form a semi-closed space around the combustion chamber, with the casing having an air-distribution adjuster so as to adjust a ratio of an air flow rate into an upstream region of the interior of the combustion chamber to another air flow rate into a downstream region of the interior of the combustion chamber, wherein the air-distribution adjuster is designed to reduce the said ratio at lower required heat generation rates to that at higher required heat generation rates.

15. The combustion apparatus as defined in claim 10, wherein the combustion chamber is provided with an air revolving means so that air introduced into the chamber are forced to swirl therein.

16. The combustion apparatus as defined in claim 10, wherein the combustion chamber has a diameter increasing towards the downstream region.

17. The combustion apparatus as defined in claim 10, wherein the combustion chamber has a diameter increasing towards the downstream region, and further has a plurality of aspiratory holes such that the interior and the exterior of the chamber are kept in fluid communication with each other through the aspiratory holes.

18. The combustion apparatus as defined in claim 10, wherein the combustion chamber is divided into a plurality of flaming sections of different diameters, the combustion chamber having an annular shoulder formed between adjacent two of the sections, and the combustion chamber further having an air revolving means at the shoulder so that air introduced into the combustion chamber are forced to swirl therein.

19. The combustion apparatus as defined in claim 10, wherein the anti-spreading means has a wall smoothly extending in a direction of the mist stream and smoothly continuing from the combustion chamber.

20. The combustion apparatus as defined in claim 10, wherein the anti-spreading means has a plurality of ventilative holes formed through the means such that the interior and the exterior thereof communicate with each other through the ventilative holes.

21. The combustion apparatus as defined in claim 10, further comprising an intermittently operating valve disposed in the fuel channel, wherein the intermittently operating valve is capable of being opened and closed periodically under the duty-ratio control conducted in response to the required amount of heat per unit time.

22. The combustion apparatus as defined in claim 10, wherein the fuel channel comprises a feed channel leading to the spraying means and a return channel for resuming a portion of the fuel once forwarded to the spraying means, with an intermittently or periodically operating valve being disposed in the return channel.

* * * * *

UNITED STATES PATENT AND TRADEMARK OFFICE

CERTIFICATE OF CORRECTION

PATENT NO. : 6,918,757 B2
DATED : July 19, 2005
INVENTOR(S) : Yutaka Nakamura et al.

It is certified that error appears in the above-identified patent and that said Letters Patent is hereby corrected as shown below:

Column 26,
Line 3, delete "resuming" and insert -- returning --.

Signed and Sealed this

Twenty-seventh Day of December, 2005

JON W. DUDAS
*Director of the United States Patent and Trademark Office*